United States Patent [19]

Toyoshi et al.

[11] Patent Number: 5,003,917

[45] Date of Patent: Apr. 2, 1991

[54] DEVELOPING APPARATUS WITH IMAGE QUALITY CONTROL

[75] Inventors: Naoki Toyoshi; Tateki Oka; Hiroshi Goto, all of Osaka, Japan

[73] Assignee: Minolta Camera Kabushiki Kaisha, Osaka, Japan

[21] Appl. No.: 391,955

[22] Filed: Aug. 10, 1989

[30] Foreign Application Priority Data

| | | | |
|---|---|---|---|
| Aug. 12, 1988 | [JP] | Japan | 63-202491 |
| Aug. 12, 1988 | [JP] | Japan | 63-202492 |
| Aug. 12, 1988 | [JP] | Japan | 63-202493 |
| Aug. 26, 1988 | [JP] | Japan | 63-213309 |

[51] Int. Cl.[5] ..... G03G 15/08

[52] U.S. Cl. ..... 118/653; 355/253

[58] Field of Search ..... 355/253, 251, 252; 118/656–658, 653

[56] References Cited

U.S. PATENT DOCUMENTS

| | | | |
|---|---|---|---|
| 4,351,604 | 9/1982 | Karasawa et al. | 118/656 |
| 4,809,034 | 2/1989 | Murasaki et al. | 353/253 |
| 4,819,027 | 4/1989 | Murasaki et al. | 355/253 |
| 4,855,783 | 8/1989 | Takashimi et al. | 118/658 |
| 4,867,100 | 9/1989 | Yamazaki et al. | 118/657 |
| 4,885,223 | 12/1989 | Enoki et al. | 118/658 X |
| 4,896,184 | 1/1990 | Kamitari et al. | 355/206 |

FOREIGN PATENT DOCUMENTS

| | | | |
|---|---|---|---|
| 37-116261 | 7/1962 | Japan . | |
| 63-38970 | 2/1988 | Japan | 355/253 |
| 63-44678 | 2/1988 | Japan | 355/253 |

*Primary Examiner*—R. L. Moses

*Attorney, Agent, or Firm*—Burns, Doane, Swecker & Mathis

[57] ABSTRACT

A developing apparatus for use in an image forming apparatus employing an electrophotographic copying process, which is capable of providing developed images of a constant image quality over a long period of operation. One of the features is an independent section for accommodating toner particles with different particle diameters within the toner hopper. Seventeen separate embodiments serve to assure an adequate mixture of small to large diameter toner particles to assure image quality.

15 Claims, 25 Drawing Sheets

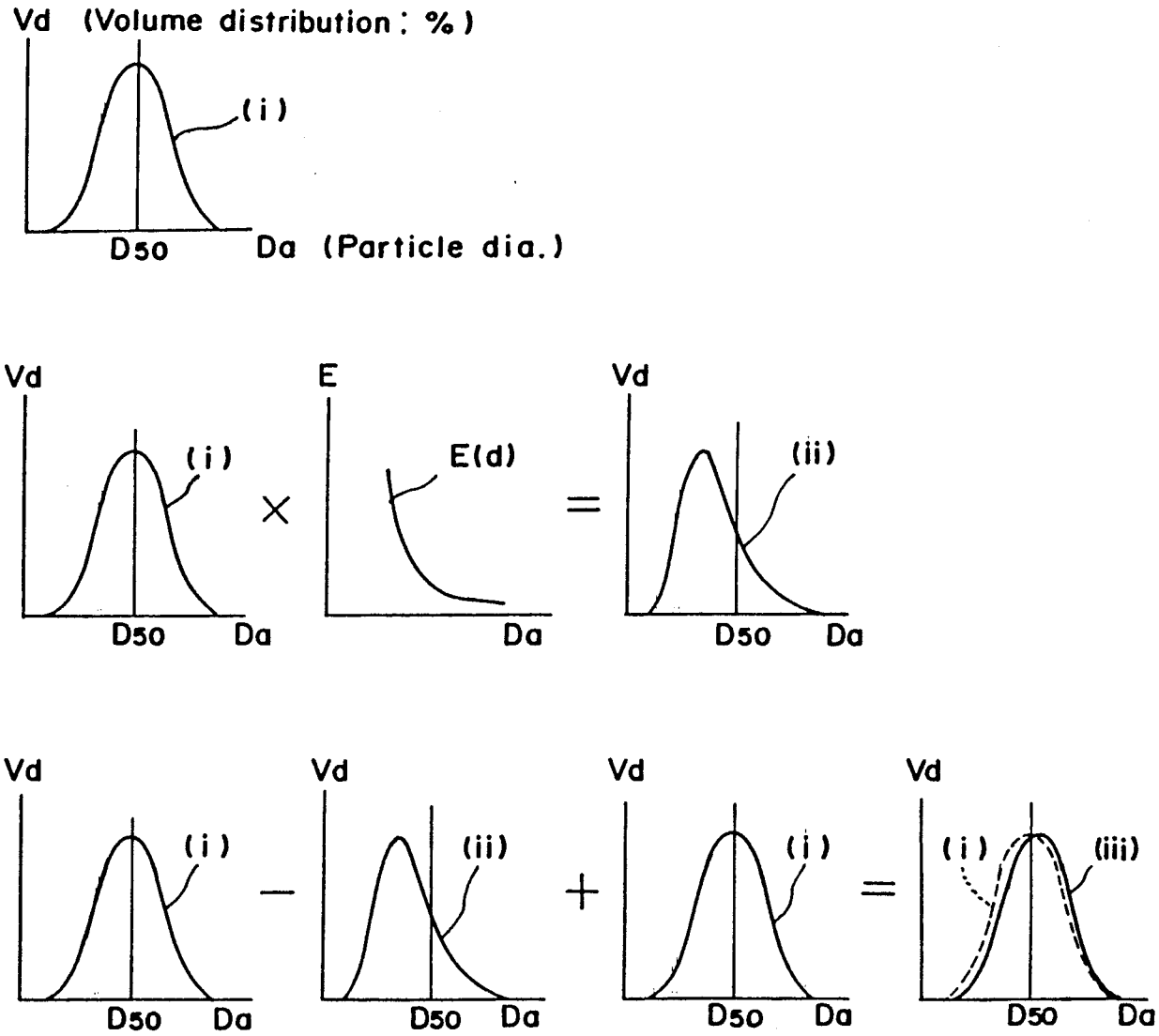
Fig. 2 (a-1) Replenish. toner
Fig. 2 (b-1) Develop. toner
Fig. 2 (c-1) Supply section toner

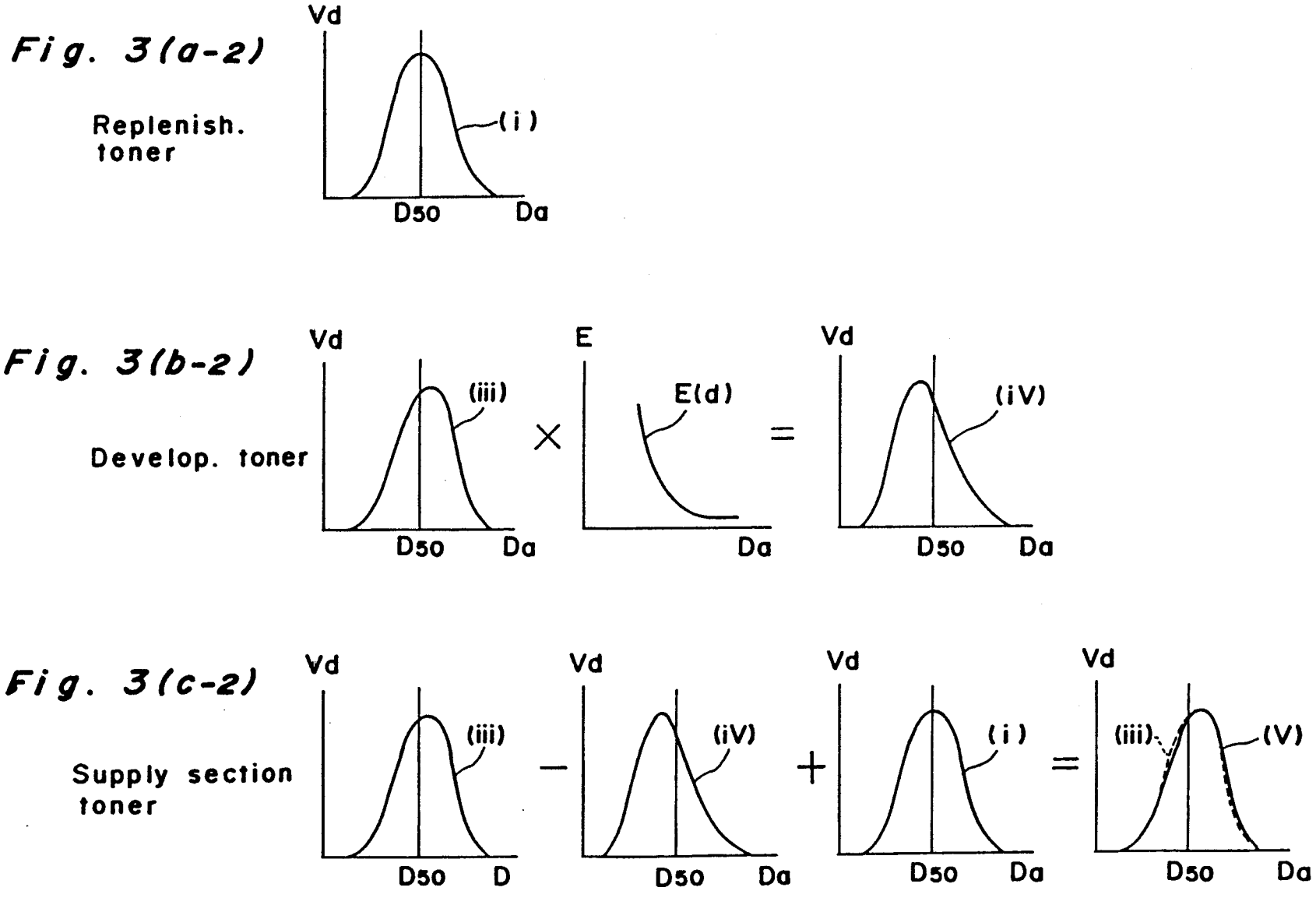
Fig. 3(a-2) Replenish. toner
Fig. 3(b-2) Develop. toner
Fig. 3(c-2) Supply section toner

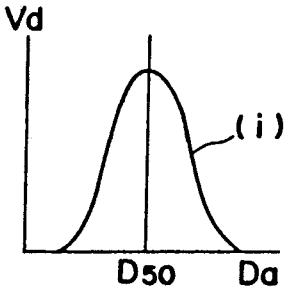
Fig. 4(a-3)
Replenish. toner
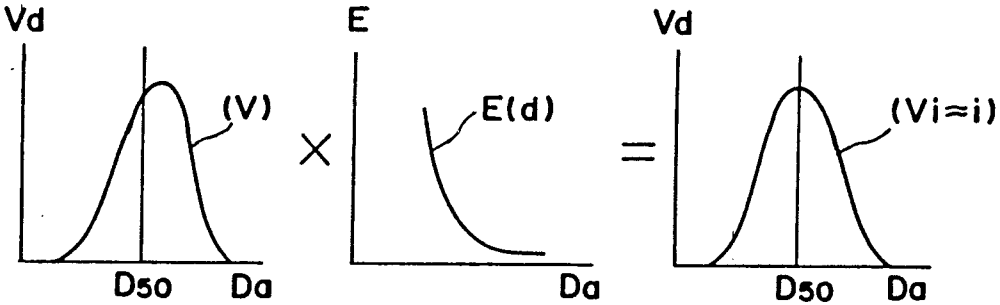
Fig. 4(b-3)
Develop. toner
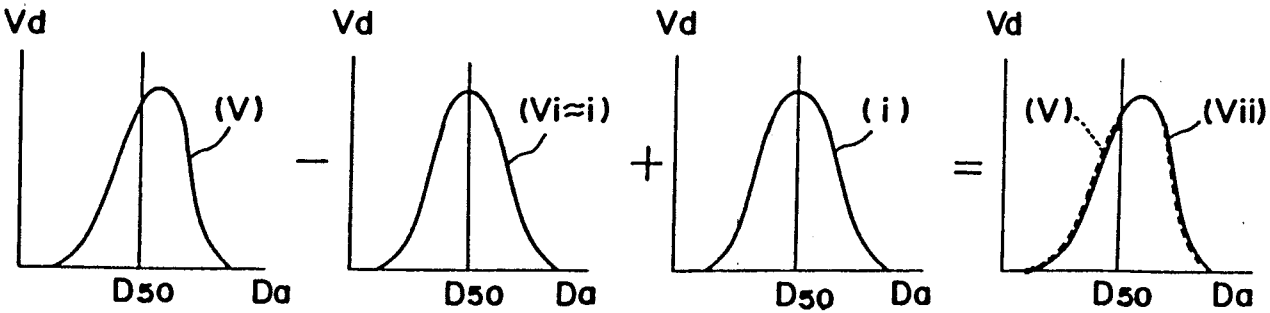
Fig. 4(c-3)
Supply section toner

DEVELOPING APPARATUS WITH IMAGE QUALITY CONTROL

BACKGROUND OF THE INVENTION

The present invention generally relates to electrophotography and more particularly, to a developing apparatus for use in an image forming apparatus based on an electrophotographic copying process.

Commonly, in a developing method for visualizing an electrostatic latent image formed on an electrostatic latent image support member, by causing charged toner to electrostatically adhere onto said electrostatic latent image, quality of images to be formed differs according to particle sizes of the toner which is employed.

More specifically, upon comparison of an image formed by toner of large particle diameters with that formed by toner of small particle diameters, edge portions (contour) and fine lines are represented more clearly and definitely in the image formed by the toner with small particle diameters.

However, in the toner manufactured by the grinding or classification process, particle diameters of toner are generally in the Gaussian distribution, ranging from large particle diameters to small particle diameters in a wide range.

Meanwhile, there has been proposed a developing apparatus so arranged that, with a toner layer thickness restricting member held in contact under pressure with a toner support member which contacts toner in a toner hopper, the toner supported on the surface of the toner support member due to on rotation of said support member is applied to the developing apparatus while being restricted by said restricting member, for example, in Japanese Patent Laid-Open Publication Tokkaisho No. 62-267782 assigned to the same assignee as in the present invention. In the developing apparatus of this kind, however, there is such a problem that, since toner with smaller article diameters is more likely to be held on the toner support member, while toner with larger particle diameters will be scraped off the surface of the toner support member by the restricting member. This occurs when the developing is started, with toner being filled in the developing apparatus in the empty state. Although a fine grained image in a good quality may be obtained through preferential consumption of the toner with small particle diameters at an initial stage of the developing, the image tends to be coarse in grain as the larger particle diameter toner comes to be gradually consumed thereafter.

SUMMARY OF THE INVENTION

Accordingly, an essential object of the present invention is to provide a developing apparatus for use in an image forming apparatus based on an electrophotographic copying process, which is capable of providing developed images of a constant image quality from an initial stage of development and maintained over a long period of operation, with substantial elimination of disadvantages inherent in the conventional developing apparatus of this kind.

Another object of the present invention is to provide a developing apparatus of the above described type which is simple in construction and stable in functioning with high reliability and can be readily incorporated into electrophotographic copying apparatuses at low cost.

In accomplishing these and other objects, according to one aspect of the present invention, there is provided a developing apparatus for use in an image forming apparatus employing an electrophotographic copying process, which includes a toner hopper in which toner is accommodated, a toner support member adapted to contact the toner accommodated in the toner hopper, and a toner layer thickness restricting member held in contact with the toner support member so as to form a thin layer of toner by restricting the toner to be supported on the surface of the toner support member based on displacement of the toner support member. The toner hopper is divided into a supply section located at the side of the toner support member and a replenishing section communicated with the supply section through an opening therebetween, with the supply section being arranged to accommodate toner having particle diameters larger than the toner in the replenishing section.

By the above developing apparatus of the present invention, owing to the arrangement that the toner having larger particle diameters is accommodated in the supply section in which the toner contacting the toner support member is accommodated, the toner of approximately the constant average particle diameter is stably supplied for the developing from the developing apparatus. Accordingly, not only the image of a uniform and constant quality is obtained from the initial stage of the developing, but such image of good quality may be maintained over a long period of operation.

In another aspect of the present invention, there is also provided a developing apparatus which includes a toner hopper in which toner is accommodated, a toner support member adapted to contact the toner accommodated in the toner hopper, and a toner layer thickness restricting member held in contact with the toner support member so as to form a thin layer of toner by restricting the toner to be supported on the surface of the toner support member based on displacement of the toner support member, with the toner hopper being divided into a supply section located at the side of the toner support member and a replenishing section communicated with the supply section through an opening therebetween, and is characterized in that there is further provided a collecting means for collecting toner of the supply section.

By the developing apparatus of the present invention as described above, when the developing is repeated by charging toner into the toner hopper, although the average particle diameter of the toner at the supply section is gradually increased due to preferential restriction of the large particle diameter toner at the forward edge of the toner layer thickness restricting member, such average particle diameter thereat is not excessively increased, since the toner at the supply section is collected by the collecting means.

In a further aspect of the present invention, there is also provided a developing apparatus which includes a toner hopper in which toner is accommodated, a toner support member adapted to contact the toner accommodated in the toner hopper, and a toner layer thickness restricting member held in contact with said toner support member so as to form a thin layer of toner by restricting the toner to be supported on the surface of the toner support member based on displacement of the toner support member, with the toner hopper being divided into a supply section located at the side of the toner support member and a replenishing section communicated with the supply section through an opening therebetween, and is characterized in that there is further provided a toner detecting means in the vicinity of the supply section and at the replenishing section respectively.

In the developing apparatus according to the present invention as described above, when the toner in the replenishing section is reduced into a state which requires replenishment, the state of "toner empty" is detected by the toner detecting means so as to prevent reduction of the toner amount at the supply section.

Meanwhile, in the case where a crosslinking phenomenon of toner is generated at the replenishing section and supply of toner to the supply section is suspended, toner level in the vicinity of the opening for the supply section is lowered to produce a discontinuous portion of toner thereat, which is detected by the toner detecting means.

In a still further aspect of the present invention, there is also provided an image forming apparatus based on an electrophotographic copying process and arranged to form an image by transferring toner supplied to an electrostatic latent image formed on a surface of an electrostatic latent image support member, onto a transfer material, and the image forming apparatus includes a selecting means for selecting a high quality image forming mode which provides and image superior in gradation, a developing apparatus which includes a toner hopper divided into a supply section and a replenishing section in its interior, a toner support member contacting toner accommodated in the supply section and a restricting member held in contact with the toner support member, thereby supplying the toner supported on the surface of the toner support member through restriction of the toner by the restricting member based on displacement of the toner support member, a removing means for removing the toner of the supply section when the high quality image forming mode is selected, and a replenishing means for replenishing toner from the replenishing section to the supply section which has been emptied by the removing means.

In the image forming apparatus having constructions as described above, the toner accommodated in the replenishing section is supplied to the supply section by the replenishing means, and further supplied from the supply section to an electrostatic latent image through the toner support member.

Thus, when the high quality image forming mode is selected, the removing means for removing the toner at the supply section is actuated, and the supply section becomes empty, with the toner removed. Subsequently, fresh toner is supplied to the supply section from the replenishing section by the replenishing means, with the toner being supplied to the toner support member as it is restricted by the restricting member. Here, since the toner is supplied to the electrostatic latent image from the toner with comparatively small particle diameters, a high quality image with favorable gradation can be advantageously obtained.

BRIEF DESCRIPTION OF THE DRAWINGS

These and other objects and features of the present invention will become apparent from the following description taken in conjunction with the preferred embodiment thereof with reference to the accompanying drawings, in which.

FIGS. and 9 are schematic side sectional views of developing apparatuses according to third and fourth embodiments of the present invention.

DETAILED DESCRIPTION OF THE INVENTION

Figure 1:
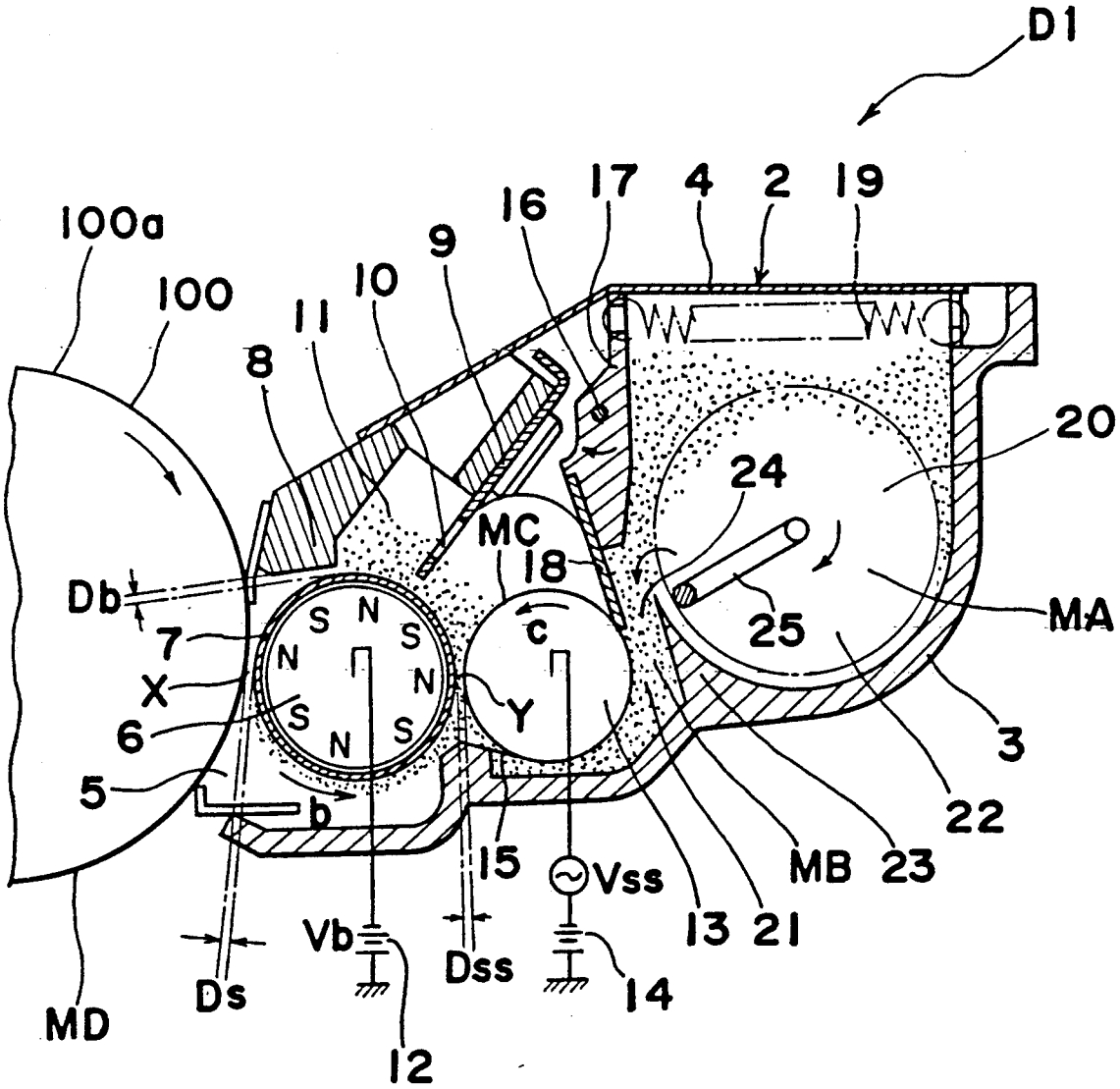
FIG. 1 is a schematic side sectional view of a developing apparatus according a first embodiment of the present invention, FIGS. 2 to are diagrams for explaining variations of toner particle diameters at various parts of the developing apparatus.

Before the description of the present invention proceeds, it is to be noted that like parts are designated by like reference numerals throughout the accompanying drawings.

I. 1st embodiment

Referring now to the drawings, there is shown in FIG. 1, a developing apparatus D1 according to a first embodiment of the present invention as disposed adjacent to a photosensive surface 100*a* of a photoreceptor drum 100 for an image forming apparatus such as an electrophotographic copying apparatus, printer or the like. In FIG. 1, the developing apparatus D1 generally includes a housing 2 constituted by a casing 3 and a cover member 4, and a cylindrical developing sleeve 7 in which a magnet member 6 is incorporated, a toner supply roller 13, and a toner hopper 20 provided within the housing 2 in a manner as described hereinbelow.

The magnet member 6 has axially extending (i.e. in a direction perpendicular to the paper surface of the drawing) magnetic poles provided on its outer periphery in alternately different polar orientations for N and S poles, and is fixedly disposed to confront the photosensitive surface 100*a* of the photoreceptor drum 100 through an opening 5 formed at a front portion (at the left side in FIG. 1) of the housing 2.

The developing sleeve 7 in the cylindrical configuration rotatably fitted around the magnet member 6 is impressed with developing bias Vb by a power source 12 and arranged to confront the photosensitive surface 100*a* of the photoreceptor drum 100 through a predetermined developing gap Ds, while a main magnetic brush bristle height restricting member 8 and an auxiliary magnetic brush bristle height restricting member 9 are adapted to confront, at their forward edges, the peripheral surface of the sleeve 7 through predetermined gaps.

The toner supply roller 13 formed with many very small concave portions (not particularly shown) on its outer peripheral surface by a blast processing, etching treatment or the like is rotatably provided at the rear portion of the developing sleeve 7 through a supply gap Dss, and applied with a collecting bias Vss by a power source 14. Moreover, a toner leakage preventing member 15 is pressed against the lower peripheral surface of the toner supply roller 13. The forward edge of a restricting blade 18 provided on support member 17 rotatably supported by the housing 2 through a shaft 16 contacts under pressure, the upper peripheral surface of said toner supply roller 13 by a spring 19 stretched between said support member 17 and a frame of the housing 2 at the upper portion of the toner hopper 20.

The toner hopper 20 is formed by partitioning the rear portion of the housing 2 by the toner supply roller 13, the toner leakage preventing member 15, the restricting blade 18 and the support member 17. Furthermore, the toner hopper 20 is divided into a supply section 21 located behind the toner supply roller 13, and a replenishing section 22 provided with a stirring member 25, by extending the rear wall of the casing 3 towards the toner supply roller 13, and further, extending its forward end portion slantwise upwardly up to the rear portion of the restricting blade 18 so as to form a partition wall 23, and such supply section 21 and the replenishing section 22 are communicated with each other through a passage 24 located between the partition wall 23 and the restricting blade 18.

In the developing apparatus D1 having the constructions as described so far, the toner in the supply section 21 is held in the very small concave portions on the surface of the toner supply roller 13 based on the rotation of said roller 13, so as to be transported in the direction indicated by an arrow c, and extra portion of the toner is scraped off the roller 13 by the forward edge of the restricting blade 18.

The toner still held on the surface of the toner supply roller 13 and passing through the contact portion of the restricting blade 18 is transported to the supply region Y, whereat, it is fed onto the surface of the developing sleeve 7'. A developing material is held on the surface of the developing sleeve 7 rotating in the direction indicated by an arrow b and an electrostatic forced based on a potential difference between the collecting bias Vss and developing bias Vb.

The toner supplied onto the surface of the developing sleeve 7 is transported in the direction of the arrow b together with the developing material, and is fed to a stirring portion 11 through the forward edge of the auxiliary bristle height restricting member 9 or through an opening formed in said restricting member 9. At the stirring section 11, the toner is mixed and stirred with the developing material so as to be imparted with electrical charge, whereby a fresh developing material is prepared.

The developing material thus prepared at the stirring portion 11, passes through the confronting portion between the developing sleeve 7 and the restricting member 8, and the predetermined amount of the developing material is transported to a developing region X for supplying toner onto an electrostatic latent image formed on the photosensitive surface 100*a* of the photoreceptor drum 100 so as to be visualized into a toner image. It is to be noted here that the amount of the developing material to be transported to the developing region X is restricted by a bristle height restricting gap Db between the main magnetic brush bristle height restricting member 8 and the surface of the developing sleeve 7.

The developing material which is passed through the developing region X is transported along the lower peripheral surface of the developing sleeve 7 in the direction of the arrow b, and is replenished with toner equivalent in amount, to the toner consumed by the developing at the supply region Y.

At the supply region Y, in addition to the toner supply function, a toner concentration control is effected for maintaining constant the toner concentration on the developing sleeve, i.e., the weight concentration of toner with respect to the carrier based on the bias difference (Vss-Vb) described earlier, and the extra toner is collected onto the toner supply roller 13 when the toner concentration on the developing sleeve 7 is above a predetermined reference value.

The toner collected onto the toner supply roller 13, is collected into the supply section 21 through the contact portion of the toner leakage preventing member 15 based on the rotation of the toner supply roller 13.

By the repetition of the above functions, when the toner of the supply section 21 comes to be decreased, a fresh toner is replenished from the replenishing section 22 into the supply section 21 through the opening 24 based on the rotation of the stirring member 25.

Incidentally, particle diameters of toner manufactured by the grinding method or classifying method are generally in a Gaussian distribution, and in the toner to be accommodated in the toner hopper 20, toner particles from large diameters to small diameters are present at a predetermined rate.

Meanwhile, in the developing apparatus D1, when the toner held on the surface of the toner supply roller 13 at the supply section 21 passes through the regulating blade 18, toner having smaller particle diameters may pass therethrough at a higher probability than toner with larger particle diameters.

Accordingly, upon starting of the developing apparatus D1, with toner charged into the toner hopper 20 in an empty state, since the toner with small particle diameters is mainly supplied to the developing sleeve 7 in the toner accommodated in the supply section 21, the image to be initially formed has fine grains, with edge portions and narrow lines being clearly reproduced.

Subsequently, variations of toner particle diameters will be described in the developing apparatus D1 as shown in FIG. 1 arranged to form a thin layer of toner on the surface of the toner supply roller 13 through rotation thereof, with the restricting blade 18 being adapted to contact under pressure said roller 13 which is a toner support member.

"Step 1" (FIGS. 2 *(a-1) to* 2 (c-1))

Upon starting of the developing function, with toner having particle diameter distribution as shown in FIG. 2(*a*-1) being charged both in the replenishing section 22 and the supply section 21 of the toner hopper 20, the toner having smaller particle diameters in the toner of the supply section 21 may be retained on the surface of the toner supply roller 13 at a higher probability, while the toner having larger particle diameters tends to be readily scraped off the surface of the toner supply roller 13 by the restricting blade 18 also at a higher probability, and therefore, the toner having larger particle diameters stays at the supply section 21, whereas the toner having smaller particle diameters is more readily supplied for the development by passing through the forward end of the restricting blade 18. It is to be noted that in FIG. 2(*a*-1), a symbol $D_{50}$ denotes an average particle diameter.

Here, it was confirmed through experiments that the toner particle diameters and the probability of the toner passing through the forward edge of the restricting blade, i.e., (Passing probability): E(d), are in a relation of a hyperbolic curve shown at the central portion of FIGS. 2(*b*-1).

Accordingly, as shown in FIGS. 2(*b*-1), the toner supplied from the supply section 21 in which the toner of particle distribution (i) is accommodated, to the developing sleeve 7 through the forward edge of the restricting blade 18, is to have a particle distribution (ii) obtained through multiplication of the particle distribution (i) by the passing probability: E(d), and thus, toner having smaller particle diameters contributes more to the developing.

Meanwhile, as shown in FIGS. 2(*c*-1), at the supply section 21, since the toner with the particle diameter distribution (ii) is consumed from the toner with the particle diameter distribution (i), while the toner with particle diameter distribution (i) is replenished by the same amount as consumed, the average particle diameter of the toner at the supply section 21 is gradually increased from the particle diameter distributions (i) to (iii).

On the other hand, as represented in FIGS. 2(*a*-1), at the replenishing section 22, since the toner equivalent to the consumption is merely consumed, without being conversely replenished from the supply section 21, the particle diameter distribution (i) at the filling of the toner may be maintained.

"Step 2" (FIGS. 3(*a*-2) to 3(*c*-2)

Further, when the developing is executed, as shown in FIGS. 3(*b*-2), the toner with the particle diameter distribution (iii) passes through the forward edge of the restricting blade at the passing probability: E(d), and consequently, the particle diameter distribution of the toner supplied for the developing shows the state as in (iv), and the particle diameter distribution (ii) at the initial state shown in FIGS. 2(*b*-1).

Meanwhile, with respect to the toner particle diameter at the supply section 21, as shown in FIGS. 3(*c*-2), since the toner with the particle diameter distribution (iv) is consumed for the developing from the toner with the particle diameter distribution (iii), while the toner with particle diameter distribution (i) is replenished from the replenishing section 22 by the same amount as the consumed amount, the toner is further increased in diameter from (iii) to (v). It is to be noted that the toner in the replenishing section maintains the state of distribution in (i) as shown in FIGS. 3(*a*-2).

"Step 3" (FIGS. 4(*a*-3) to 4(*c*-3))

When the state at Step 2 further proceeds, as shown in FIGS. 4(*b*-3), the toner in the distribution (v) passes through the restricting blade at the passing probability: E(d), and the toner with the particle diameter distribution (vi) is supplied for the developing. This toner particle diameter distribution (vi) gradually approximates to the distribution (i) at the filling as the particle diameter of the toner at the supply section becomes larger.

On the other hand, at the supply section 21, the toner with the distribution (v) is consumed from the toner with the distribution (vi), and the toner with the distribution (i) is replenished. When the particle diameter of the toner to be consumed gradually approximates to (i) as described earlier, the toner particle diameters for the consumption and replenishment are generally balanced, so that the toner at the replenishing section is to be supplied for the developing as it is, and the particle diameter at the supply section 21 is stabilized in the state of (vii).

Therefore, subsequently, toner having approximately the same average particle diameter as the average particle diameter (i) is stablely supplied for the developing, while the toner particle diameter in the supply section 21 is stablely maintained in the state of (vii).

The phenomena as described so far were confirmed through experiments carried out under the conditions as follows.

| | | |
|---|---|---|
| (a) | Toner supply roller (13) | |
| | Diameter | 20 mm |
| | Revolution | 200 rpm |
| | Collecting bias (Vss) | DC-400 V<br>AC 700 Vrms |
| | AC frequency | 300 Hz |
| | Surface roughness | 40 μm |
| (b) | Developing sleeve (7) | |
| | Diameter | 24.5 mm |
| | Revolution | 200 rpm |
| | Developing bias (Vb) | DC-200 V |
| (c) | Gap | |
| | Developing gap (Ds) | 0.6 mm |
| | Bristle height restrict. gap | 0.45 mm |
| | Supply gap (Dss) | 0.8 mm |
| (d) | Regulating blade (18)<br>Material Stainless Steel | |
| | Thickness | t = 100 μm |
| | Pressure contact force | 0.1 g/mm |
| (f) | Toner | |
| | Ave. Particle dia. at filling | 14 μm |

Figure 5:
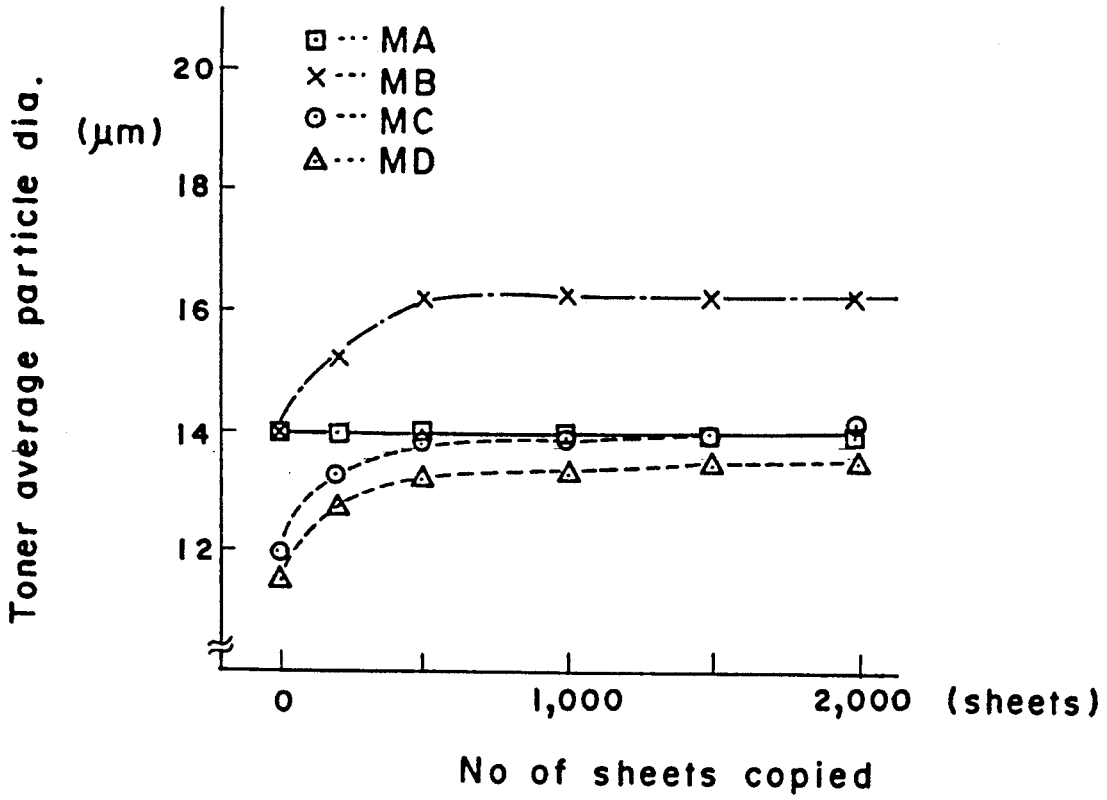
Fig. 5 PRIOR ART
FIGS. 5 and 6 are characteristic diagrams showing relations between the number of copied sheets and toner average particle diameters.

As a result of the experiments, as shown in FIG. 5, when the toner with the same particle diameter (14μm) was charged into the supply section 21 and the replenishing section 22, although the average particle diameter of the toner taken on the surface (at measuring point MD) of the photoreceptor drum 100 was small at abut 11.5μm at the initial stage of developing, it showed a tendency to be gradually increased, and was slowly stabilized at the number of copied sheets of about 500 so as to be finally stabilized under the state of about 13.6μm at the number of copied sheets of 2,000.

Although the average particle diameter of the toner taken on the surface (at measuring point MC) of the toner supply roller 13 was initially 12μm, it showed the trend generally similar to the average particle diameter on the photoreceptor drum 100, and was ultimately stabilized at the number of copied sheets of 2000 in a state where it coincided with the average particle diameter at the filling.

The toner at the supply section 21 (at measuring point MB) is gradually increased in its particle diameter after starting of copying, so as to be at about 16μm at the number of copied sheets of 500, with such state being maintained thereafter.

The toner particle diameter at the replenishing section 22 (at measuring point MA) is not varied at all times, with the average particle diameter of 14μm being maintained.

By the foregoing description and experiments, it may be presumed that, if the toner with larger particle diameter than the toner in the replenishing section 22 is accommodated in the supply section 21, i.e. when the toner of the distribution (i) is accommodated in the replenishing section 22, while the toner of the distribution (vii) with larger particle diameter than the above is contained in the supply section 21, toner having particle diameter distribution approximate to (i) is supplied for the developing from the initial stage, and the toner ultimately supplied for the developing is stabilized under the state generally coinciding with the distribution (i) of the replenishing section 22.

Subsequently, by continuously effecting copying with toner of average particle diameter of 14μm accommodated in the replenishing section 22, and toner of average particle diameter of 16μm contained in the supply section sample toners were taken per predetermined numbers of copied sheets at the replenishing section 22 (measuring point MA), supply section 21 (measuring point MB), surface of the toner supply roller 13 (measuring point MC), and surface of the photoreceptor drum 100 (measuring point MD) for the measurements of the average particle diameters.

Figure 6:
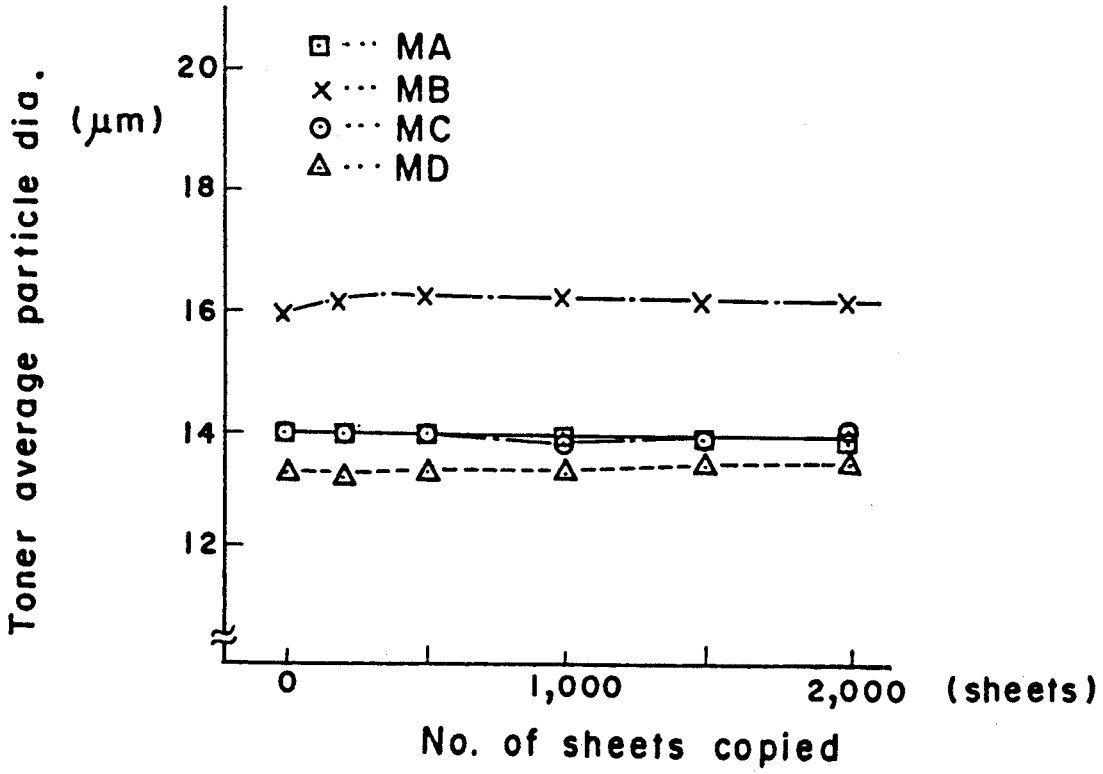

As a result, as shown in FIG. 6, the average particle diameter of the toner at the point MA for the replenishing section 22 was maintained at 14μm at all times. Meanwhile, the average particle diameter of the toner at the measuring point MB for the supply section 21 became slightly larger than that at the filling of the toner, and was stabilized under the state with the average particle diameter of 16.2μm. Moreover, at the point MD on the surface of the photoreceptor drum 100, and at the point MC on the surface of the toner supply roller 13, the average particle diameters of the toner are maintained in the state of 14μm, and 13.4 to 13.5μm at all times respectively, and for the developing, toner having the average particle diameter of 16μm approximately the same as the average particle diameter 16.2μm of the toner contained in the replenishing section 22, was stablely supplied at all times.

II. 2nd embodiment

Figure 7:
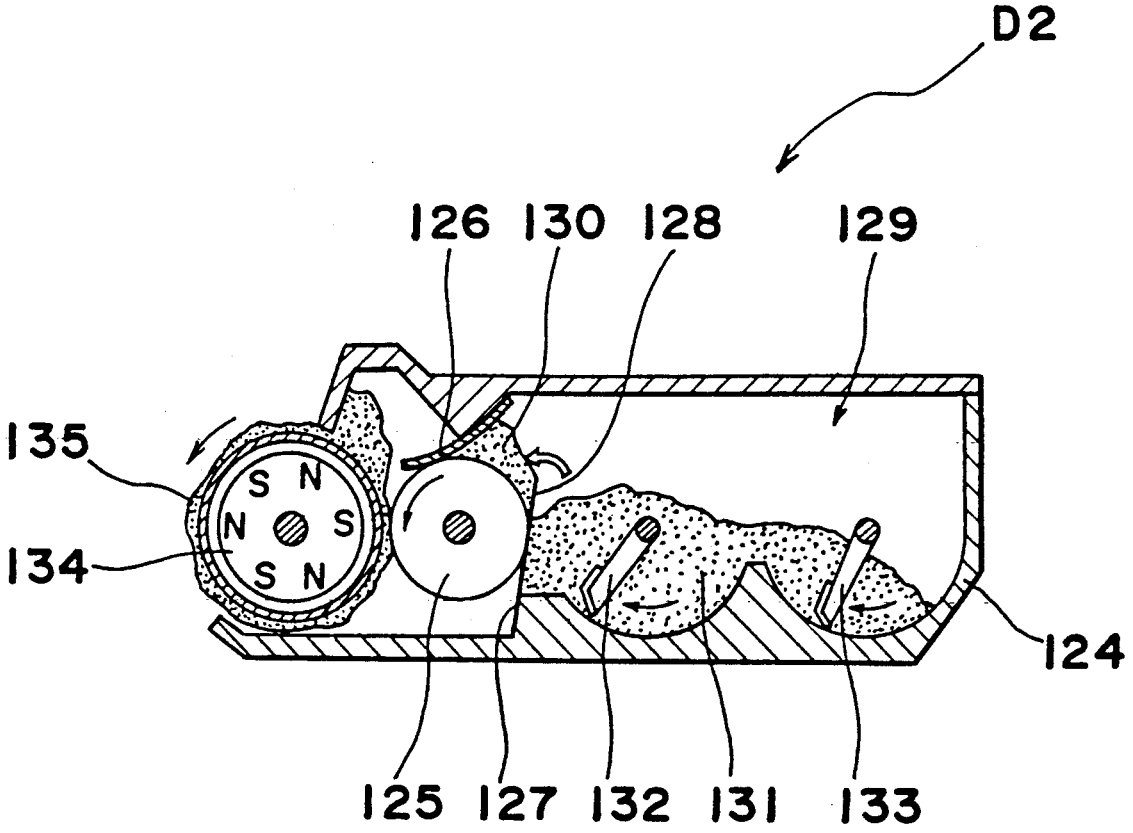
FIG. 7 is a schematic side sectional view of a developing apparatus according to a second embodiment of the present invention.

In a developing apparatus D2 as shown in FIG. 7, the forward edge portion of a restricting blade 126 attached to the housing 124 is held in pressure contact with the surface of a toner supply roller 125 along the rotating direction of said roller 125, while a restricting member 127 is held in pressure contact with the back surface (i.e., at the right side in FIG. 7) of the toner supply roller 125, with the forward edge of the restricting member 127 being extended upwardly to form a partition wall 128, by which a toner hopper 129 defined in the housing 124 is divided into a supply section 130 and a replenishing section 131. Meanwhile, in the replenishing section 131, there are provided two stirring members 132 and 133, and the toner within the replenishing section is supplied to the supply section 130 while being stirred by these stirring members 132 and 133. At the left side of the housing 124 of the apparatus D2, a magnet member 134 is fixedly accommodated in a developing sleeve 135 rotatably provided in the similar manner as in the first embodiment of FIG. 1.

In the above developing apparatus D2 of FIG. 7 also, if toner having larger particle diameters than the toner in the replenishing section 131 is charged in the supply section 130, the toner having approximately the same average particle diameter as that of the toner contained in the replenishing section 131 is supplied for the developing from the start, and thus, an image with a predetermined density may be stably obtained.

III. 3rd and 4th embodiments

Figure 8:
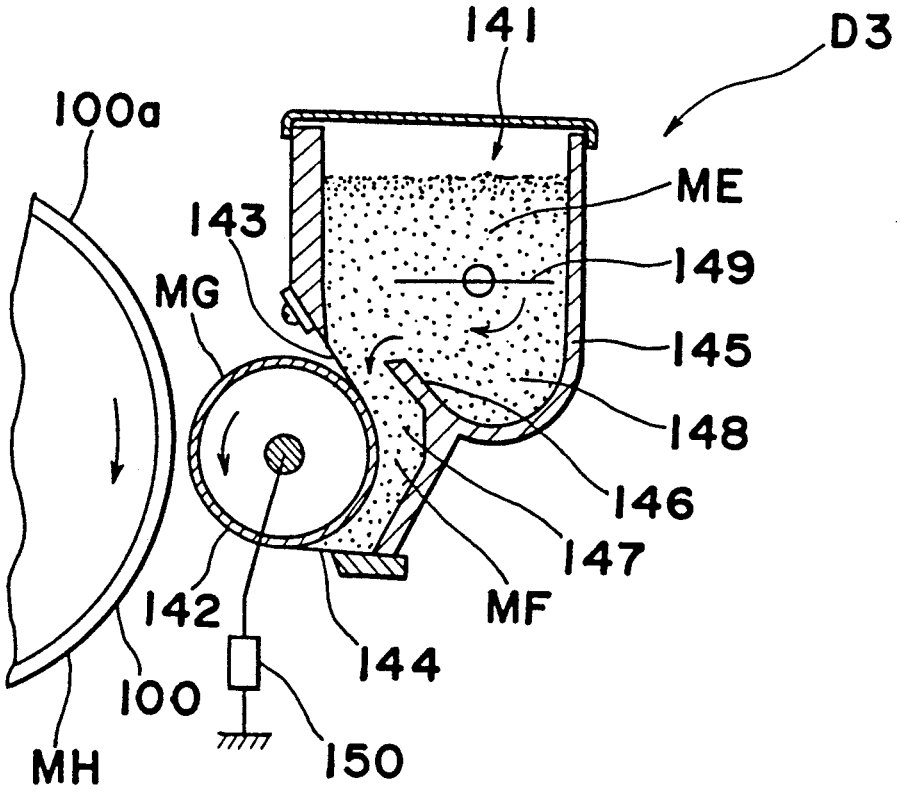
Figure 9:
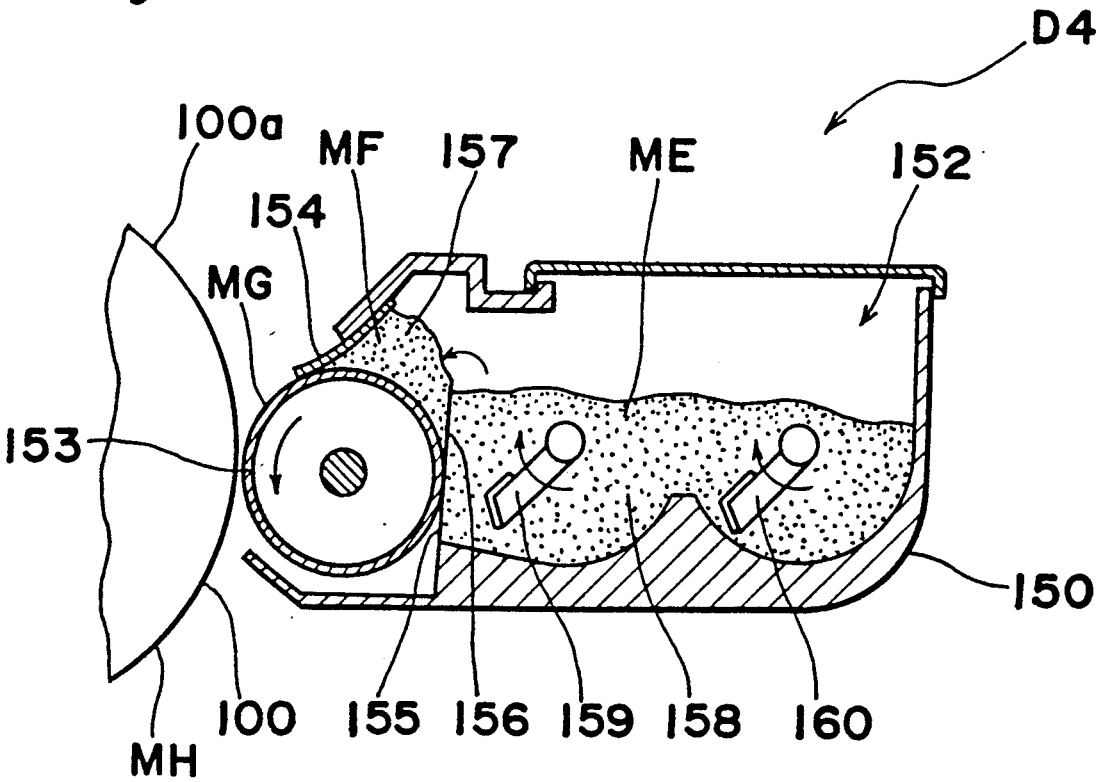

Although the first and second embodiments have been described so far with reference to the developing apparatuses employing a two-component developing material composed of toner and carrier, the present invention is not limited in its application to the developing apparatuses using such two-component developing material alone, but may also be applied to developing apparatuses employing a monocomponent developing material as shown in FIGS. 8 and 9.

A developing apparatus D3 shown in FIG. 8 includes a toner hppper 141 formed in a housing 145, and a metallic developing roller 142 rotatably provided at a lower opening of the toner hopper 141, with a restricting blade 143 and a restricting member 144 attached to the housing 145 being pressed against the outer peripheral portion of said roller 142. The bottom portion of the housing 145 is extended up to a position confronting the restricting blade 143 to form a partition wall 146, thereby to divide the interior of the toner hopper 141 into a supply section 146 located at the back of the developing roller 142 and a replenishing section 148, while a toner stirring member 149 being rotatably provided in the replenishing section 148. A power supply 150 is connected to the developing roller 142 for applying a bias voltage thereto.

On the other hand, in the developing apparatus D4 as shown in FIG. 9, a restricting blade 154 and a restricting member 155 fixed to the housing 150 are held in pressure contact with the peripheral surface of a metallic developing roller 153 rotatably provided at the forward opening of a toner hopper 152, while the forward edge of the restricting member 155 being further extended upwardly to form a partition wall 156, by which the interior or the toner hopper 152 is divided into a supply section 157 and a replenishing section 158, with two stirring members 159 and 160 being similarly provided within the replenishing section 158.

Figure 10:
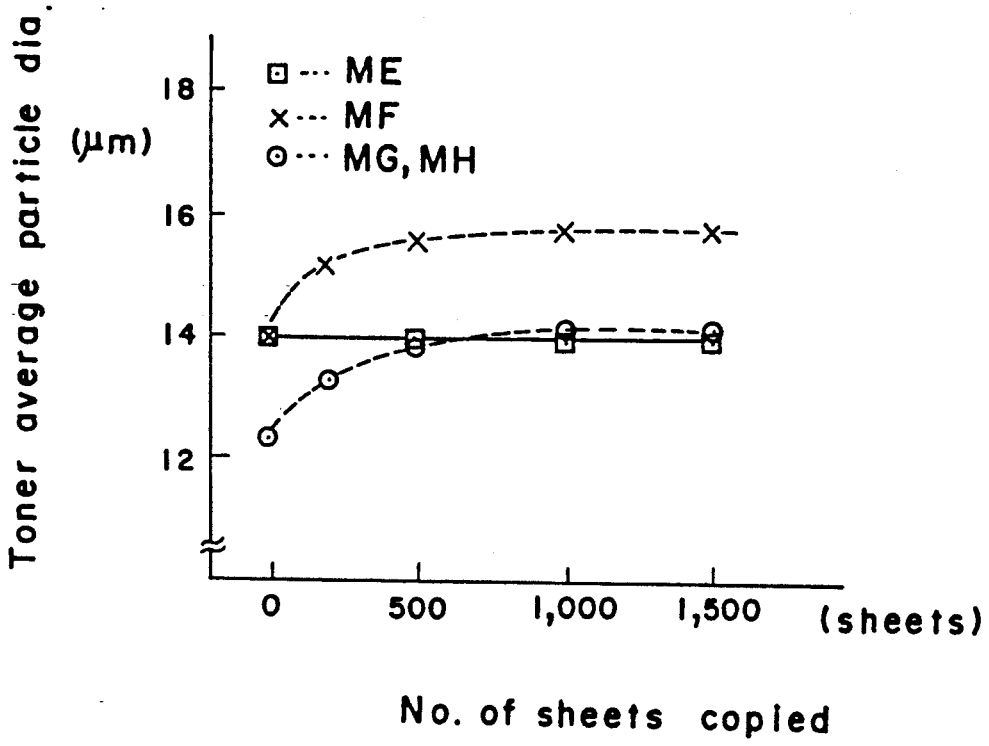
FIGS. 10 and 11 are characteristic diagrams showing relations between the number of copied sheets and toner average particle diameters, in the developing apparatuses shown in FIGS. 8 and 9, FIGS. 12 and 13 are schematic side sectional views of developing apparatuses according to fifth and sixth embodiments of the present invention.
Figure 11:
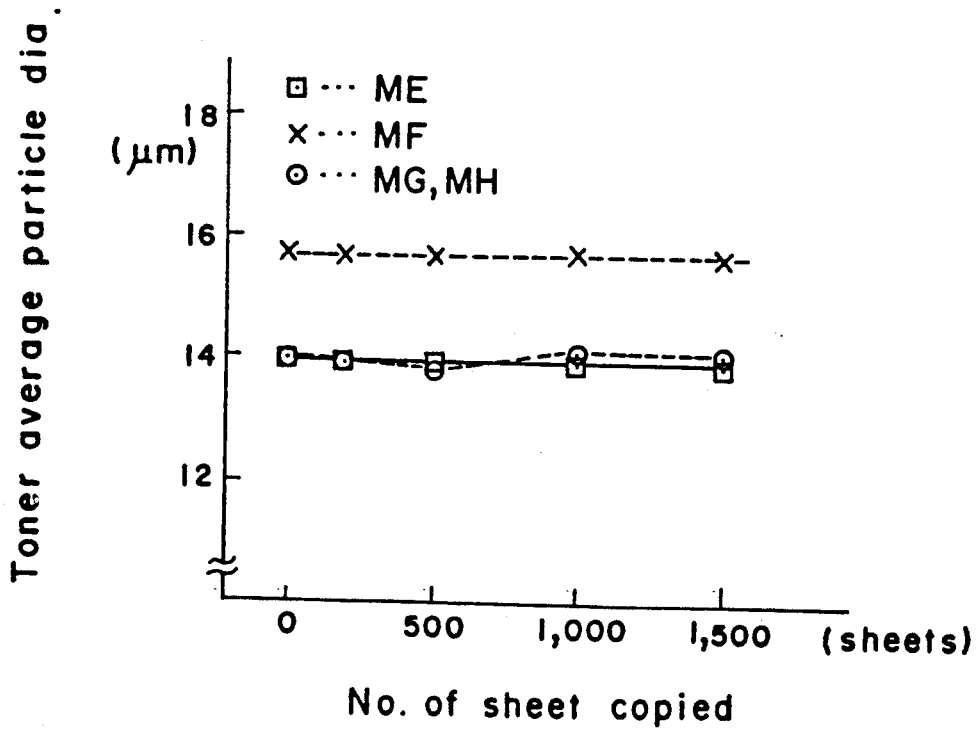

In the developing apparatuses D3 and D4 having the above constructions, if the toner having the same average particle diameter distribution was charged into both of the supply sections 147 and 157, and the replenishing sections 148 and 158, as shown in FIG. 10, although the average particle diameter of the toner at the replenishing section (measuring point ME) was maintained to be the average particle diameter at the filling, the average particle diameter of the toner at the supply section (measuring point ME) was gradually increased, to be about 15.5μm at the number of copied sheets of 500 and was stabilized at about 15.7μm at the number of coped sheets above 1,000.

Meanwhile, to the measuring point MG of the developing rollers 142 and 153, and the measuring point MH of the photoreceptor drum 100, toner having the average particle diameter of about 12.3μm was initially supplied, and thereafter, the particle diameter was gradually increased to be about 15.8μm at the number of copied sheets of 500, and about 16μm at the number of copied sheets of 1,000.

Accordingly, when the developing apparatuses D3 and D4 in which a fresh toner was accommodated are employed, images with an insufficient image density are to be produced for several hundred sheets from the starting of operation.

On the other hand, in the case where the toner with the average particle diameter of 14μm is charged in the replenishing sections 148 and 158, and the toner with average particle diameter of 16μm is filled in the supply sections 147 and 157, the average particle diameter of the toner in the supply section 147 and 157 is maintained at about 15.7μm at all times, while the average particle diameter of the toner in the replenishing sections 148 and 158 is retained at 14μm.

Moreover, the average particle diameter of the toner on the surface (measuring point MH) of the photoreceptor drum 100 and the surface (measuring point MG) of the developing rollers 142 and 153 are also maintained at approximately 14μm at all times, thus providing image of a proper density from the initial stage of starting of copying.

IV. 5th embodiment

The developing apparatus D5 shown in FIG. 12 has the construction generally similar to the developing apparatus D4 described with reference to FIG. 9, but the metallic developing roller 153 in FIG. 9 is replaced by a resilient developing roller 161 made of rubber or the like, with a contact portion 163 of a semi-circular cross section being provided at the forward edge of a resilient blade 162 fixed to the housing 160. In this developing apparatus D5 also, images of a desired density may be stablely obtained from the starting of development by filling a supply section 165 partitioned by a partition wall 164 with toner having larger particle diameter than the toner contained in a replenishing section 166.

V. 6th embodiment

Figure 12:
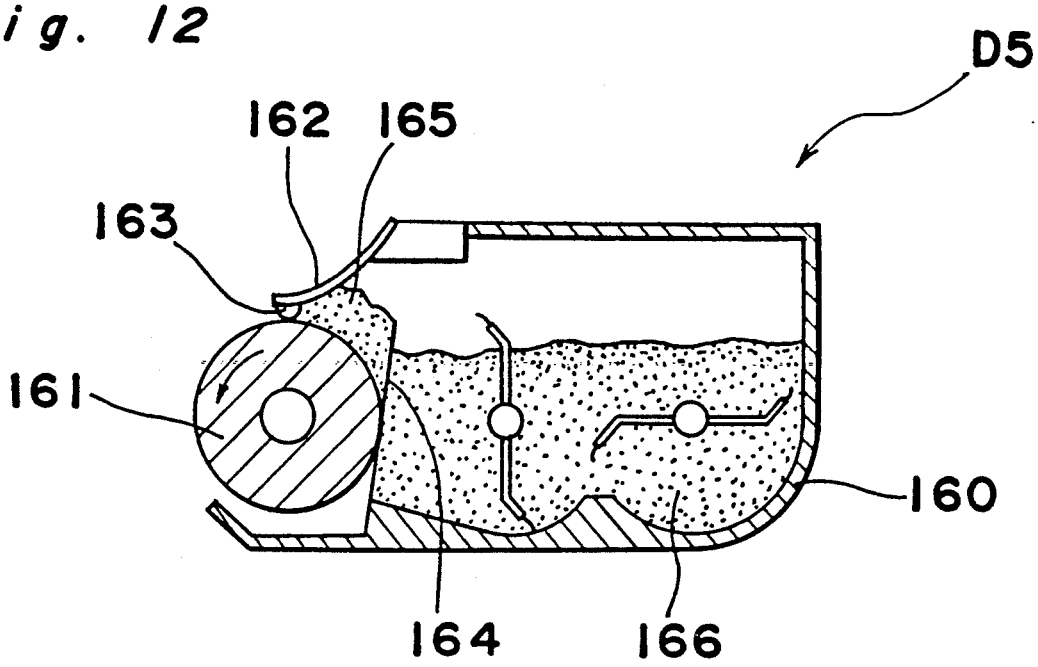
Figure 13:
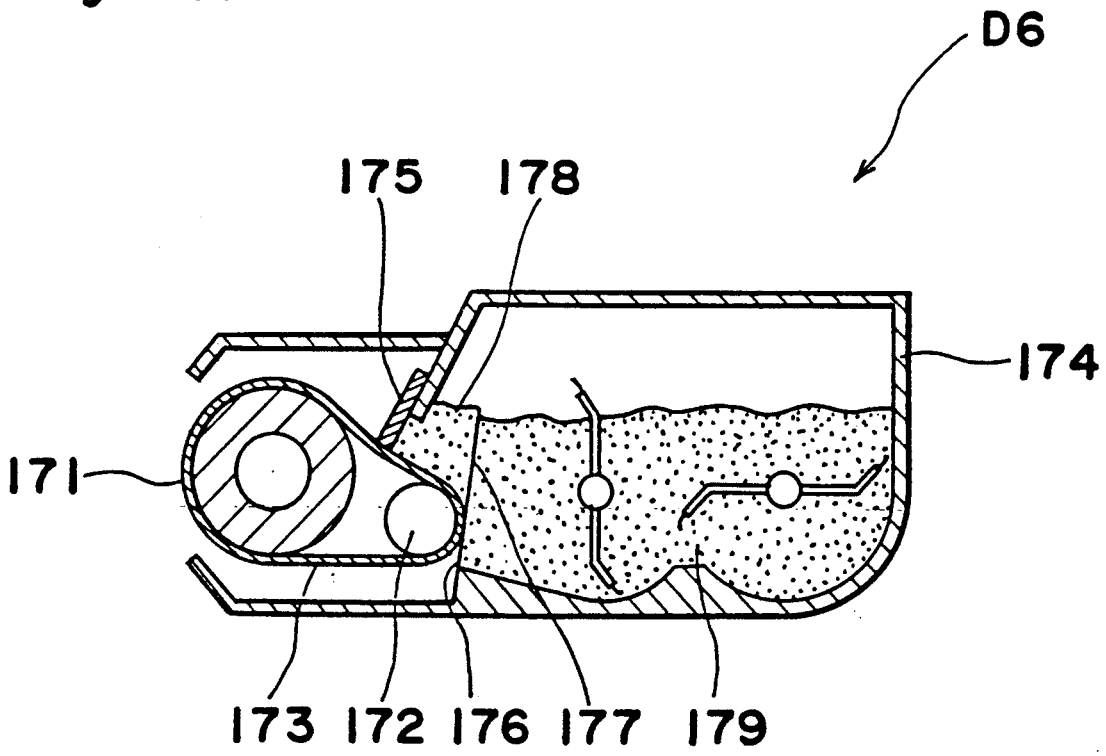

In the developing apparatus D6 shown in the FIG. 13, the resilient developing roller 161 in the developing apparatus D5 in FIG. 12 is replaced by a roller and belt device including a set of spaced rollers 171 and 172 and a toner support belt 173 made, for example, of a metallic thin film, polyester film or the like, and movably passed around said rollers 171 and 172, while a blade 175 provided at the upper portion of a housing 174 being pressed against the belt 173, with a restricting member 176 provided at the bottom portion of the housing being arranged to contact the rear roller 172 through said belt 173. The forward edge 177 of said restricting member 176 is extended upwardly to form a supply section 178 and a replenishing section 179. In this developing apparatus D6 also, toner having desired particle diameters may be stably supplied for the developing from the initial stage of operation.

It should be noted here that, in the foregoing embodiments, although the supply section and the replenishing section are arranged to be communicated with each other through the opening, the arrangement may, for example, be so modified as disclosed in Japanese Patent application Tokugansho No. 62-292464 assigned to the same assignee as in the present invention, that a shutter member capable of properly shutting off the communication between the supply section and the replenishing section is further provided to prevent a mixture of the toner in the supply section and replenishing section during attachment or detachment of the developing apparatus with respect to an image forming apparatus, whereby toner having approximately constant particle diameter at all times may be positively fed to the development.

As is seen from the foregoing description, according to the developing apparatuses of the present invention, since it is so arranged that the toner having larger particle diameters than the toner in the replenishing section is accommodated in the supply section containing the toner which contacts the toner support member, toner having approximately the constant particle diameter may be stablely supplied for the developing from the developing apparatus.

Accordingly, images of a predetermined image quality may be obtained from the starting of the developing, so as to be maintained for long periods.

VII. 7th embodiment

Figure 14:
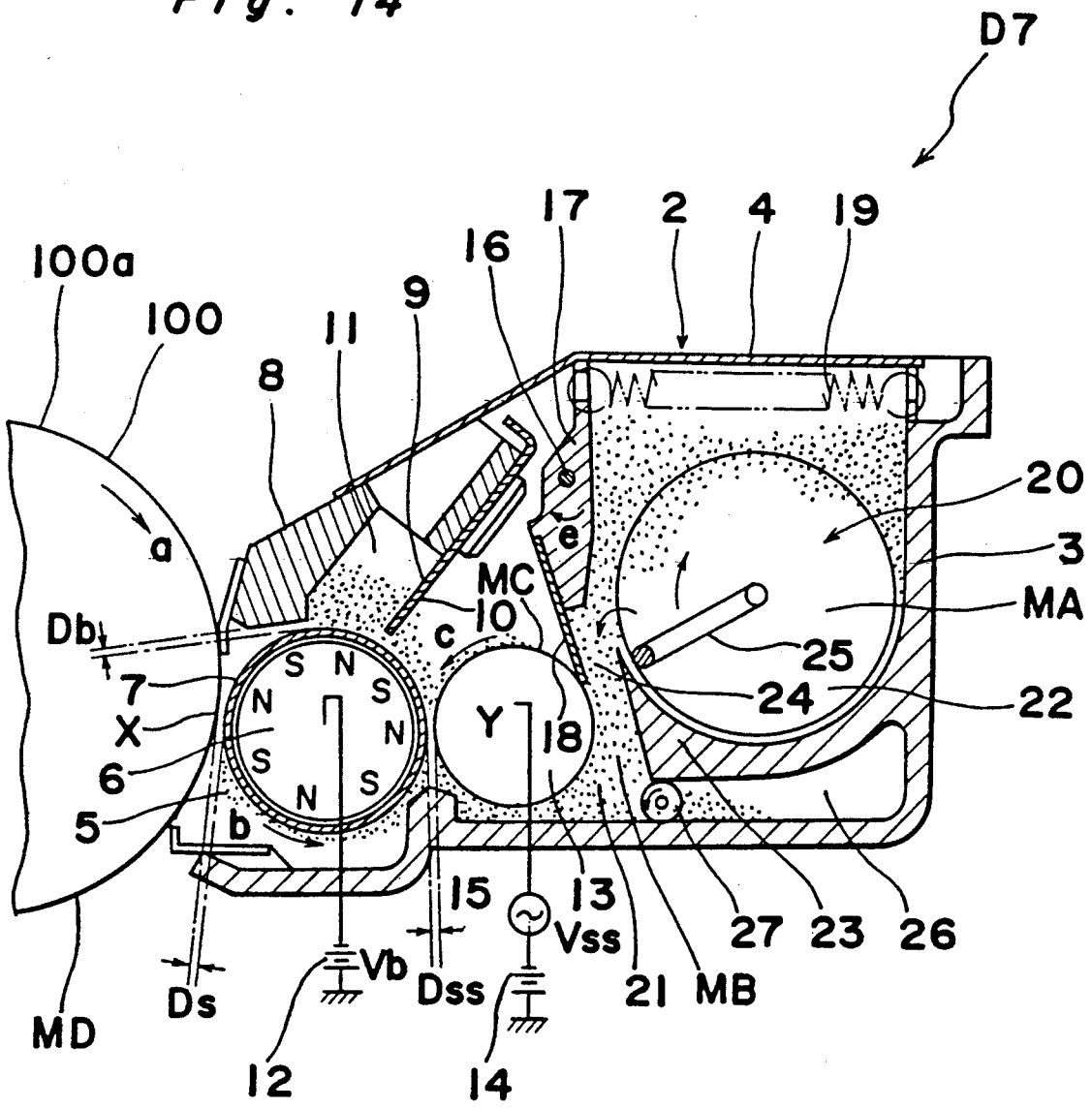
FIG. 14 is a schematic side sectional view of a developing apparatus according a seventh embodiment of the present invention.

In FIG. 14, there is shown a developing apparatus D7 which is a modification of the developing apparatus D1 described earlier with reference to FIG. 1. In the arrangement of FIG. 14, since the parts represented by the numerals 1 to 25 are the same as those in the developing apparatus D1 in FIG. 1, detailed description thereof is abbreviated here for brevity.

In addition to the constituting parts 1 to 25 in the developing apparatus D1 in FIG. 1, the developing apparatus D7 of FIG. 14 further includes a collecting section 26 formed in the housing 4 in a position, below the partition wall 23 and communicated with the supply section 21, while at an outlet portion of said collecting section 26, a collecting screw 27 is rotatably provided so as to close said outlet port.

In the above developing apparatus D7, the collecting screw 27 is driven for a predetermined period of time in synchronization with rotation of the toner supply roller 13 so as to gradually extract, by a predetermined amount, the toner in the supply section 21 tending to increase in particle diameter.

As a result, the average particle diameter of the toner at the supply section 21 is not increased to exceed a predetermined value. Thus, it becomes possible to continuously form fine grain images.

Comparative experiments were carried out by driving the developing apparatus D7 of FIG. 14 and a developing apparatus D7 of FIG. 14 and a developing apparatus (not particularly shown) in which the collecting section 26 and the collecting screw 27 are removed from said developing apparatus D7, so as to investigate the variation of toner particle diameters at various parts.

In the above experiments, the toner particle diameters were measured at points as follows.

* Measuring point MA . . . Replenishing section 22
* Measuring point MB . . . Supply section 21
* Measuring point MC . . . Surface of the toner supply roller 13 passing through the forward edge of the restricting blade 18.
* Measuring point MD . . . Surface of the photoreceptor drum 100 passing through the developing region X.

| Conditions for experiments | |
|---|---|
| (a) Developing sleeve (7) | |
| Diameter | 24.5 mm |
| Revolution | 200 rpm |
| Developing bias (Vb) | DC-200 V |
| (b) Toner supply roller (13) | |
| Diameter | 20 mm |
| Revolution | 200 rpm |
| collecting bias (Vss) | DC-400 V<br>AC 700 Vrms |
| AC frequency | 300 Hz |
| Surface roughness | 40 μm |
| (c) Collecting screw (27) | |
| Diameter | 6.5 mm |
| Revolution | 1.0 rpm |
| Collecting rate | 10% of total amount of toner |
| (d) Gap | |
| Developing gap (Ds) | 0.6 mm |
| Bristle height restrict. height | 0.45 mm |
| Supply gap (Dss) | 0.8 mm |
| (e) Restricting blade (18) Material Stainless Steel | |
| Thickness | t = 100 μm |
| Pressure contact force | 0.1 g/mm |
| (f) Toner | |
| Ave. particle dia. at filling | 14 μm |

Figure 15:
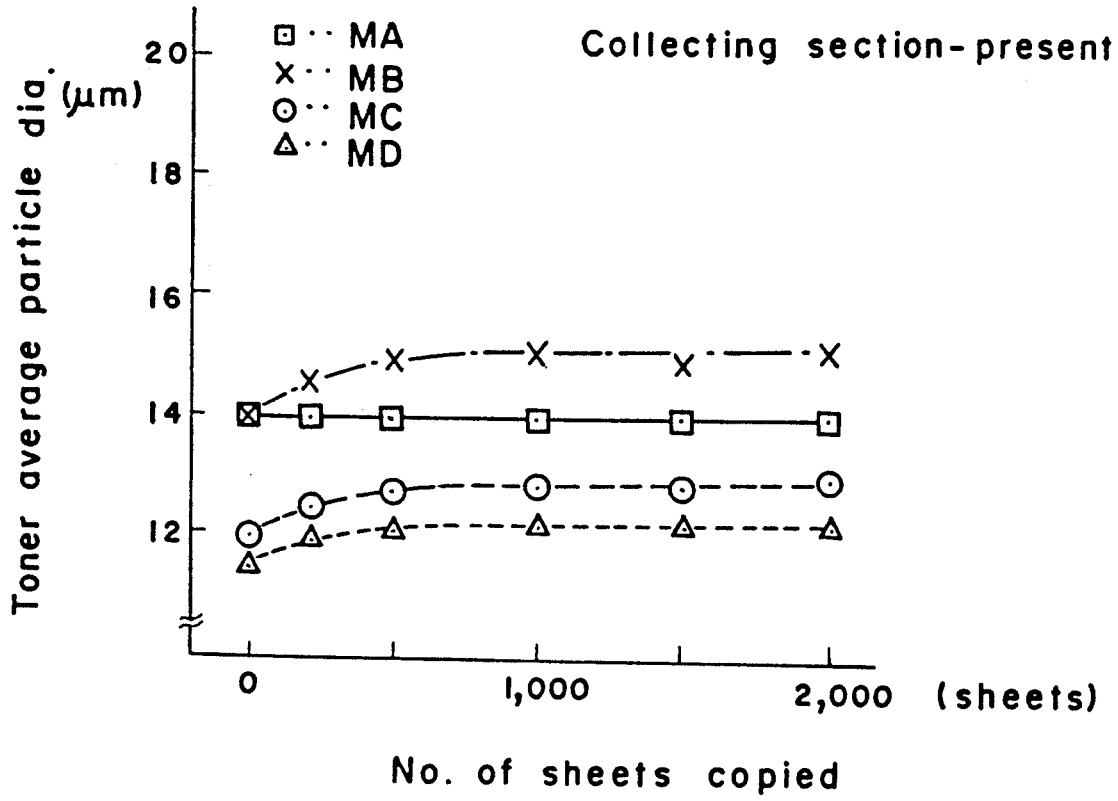
FIG. 15 is a characteristic diagram showing relation between the number of copied sheets and toner average particle diameter by the developing apparatus of FIG. 14.
Figure 16:
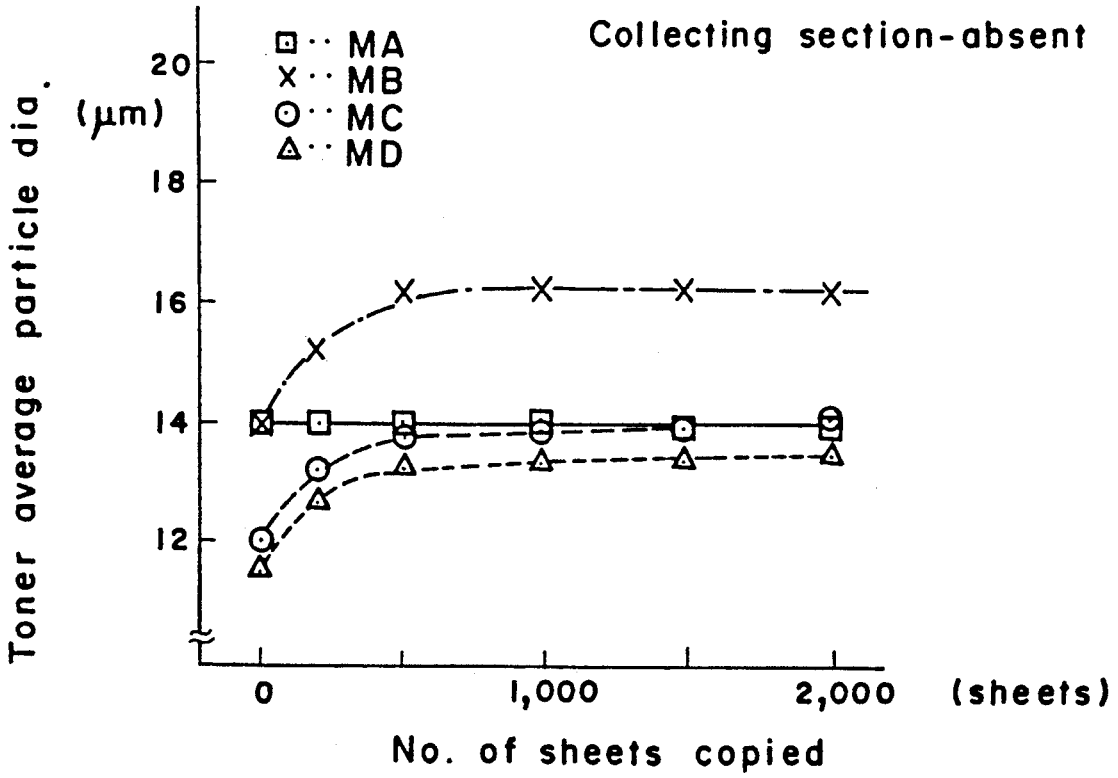
FIG. 16 is a characteristic diagram showing relation between the number of copied sheets and toner average particle diameter by a developing apparatus without a collecting section.

Developing was carried out through employment of the developing apparatus D7 and the developing apparatus without the collecting section 26, and the toner average particle diameters at the respective measuring points were measured predetermined number of copied sheets As a result, variations of the average particle diameters as shown in FIGS. 15 and 16 were observed.

As shown in FIG. 16, in the developing apparatus without the collecting section, the average particle diameter of toner at the replenishing section 22 (measuring point MA) is maintained to be the average particle diameter of 14μm at the filling irrespective of the number of copied sheets. Although the average particle diameter at the supply section 21 (measuring point MB) was generally increased up to the number of copied sheets of about 500, it was stabilized thereafter at about 16.2μm. On the surface (measuring point MC) of the toner supply roller 13, he average particle diameter which was 12μm at the initial stage was gradually increased as the number of copied sheets increased, up to about 13.8μm at the number of copied sheets of 500, and thereafter, almost stopped increasing at the number of copied sheets of 2,000 so as to be stabilized at 14μm. Meanwhile, on the surface (measuring point MD) of the photoreceptor drum 100, although the average particle diameter of the toner was about 11.5μm at the initial stage, it showed a tendency similar to that on the surface (measuring point MC) of the toner supply roller 13, and was increased up to about supply roller 13, and was increased up to about 13.3μm at the number of copied sheets of 500, so as to be stopped increasing at about 2,000 sheets for stabilization approximately at 13.7μm.

As described so far, in the developing apparatus without the collecting section 26, although the average particle diameter at the supply section 21 becomes larger than the average particle diameter of 14μm at the filling, the average particle diameter of the toner to be actually used for the developing becomes the average particle diameter of 14μm at the filling, and consequently, the toner charged into the toner hopper 10 is supplied for developing as is.

On the other hand, in the developing apparatus D7 provided with the collecting section 26, the average particle size of the toner at the replenishing section 22 (measuring point MA) is maintained to be the average particle diameter of 14μm at the time of filling at all times. At the supply section 21 (measuring point MB), the average particle diameter was gradually increased from the starting of the copying operation so as to be 14.9μm at the number of copied sheets of 500, and was thereafter stabilized at 15.2μm. Furthermore, at the measuring point MC on the toner supply roller 13, the average particle diameter which was 12μm initially, was gradually increased so as to be stabilized at 12.7μm. At the measuring point MD of the photoreceptor drum 100, the average particle diameter was 11.5μm initially, but was gradually increased in the similar manner as in the measuring point MC so as to be stabilized at 12.2μm.

As described so far, in the developing apparatus D7 provided with the collecting section 26, the ultimate average particle diameter at the measuring point MD was smaller by about 1.5μm (=13.7μm−12.2μm) than that in the developing apparatus without the collecting section 26, and thus, toner with small particle diameters is stably supplied for developing to continuously provide images with fine grains.

VII. 8th embodiment

Figure 17:
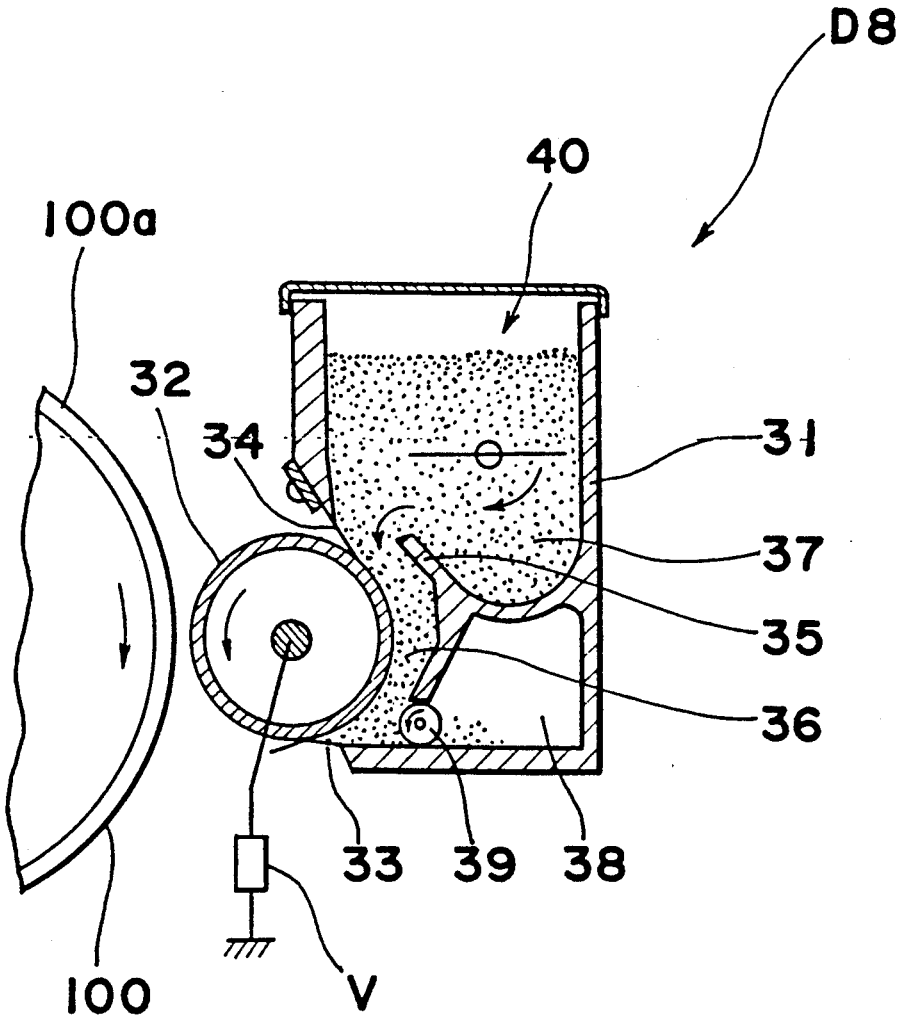
FIG. 17 is a schematic side sectional view of a developing apparatus according to an eighth embodiment of the present invention.

Different from the developing apparatus D7 of FIG. 14, the developing apparatus D8 shown in FIG. 17 is intended to employ a mono-component developing material, and includes a housing 31, a developing roller 32 rotatably provided at a lower opening of the housing 31 with a bias voltage source V being connected thereto, and a toner leakage preventing member 33 and a restricting blade 34 provided on the housing 31 so as to be held in pressure contact with the outer peripheral surface of the developing roller 32, a toner hopper 40 formed in the housing 31 is divided into a supply separation 36 and a replenishing section 37 by a partition wall 35 formed by extending part of a frame of the housing 31 up to a position behind the restricting blade 34. Beside the supply section 36, a collecting section 38 is formed in a position below the toner hopper 40, while a collecting screw 39 is provided at an opening portion communicating said collecting section 38 with the supply section 36.

In the above developing apparatus D8, although the toner average particle diameter in the supply section 36 is gradually increased, since the toner thereat is collected little by little, into the collecting section 38 as the developing roller 32 rotates, toner having smaller particle diameter than the toner charged into to the toner hopper 40, is supplied onto the surface 100*a* of the photoreceptor drum 100 through the developing roller 32, and thus, clear and definite images with fine grains may be advantageously obtained.

Figure 18:
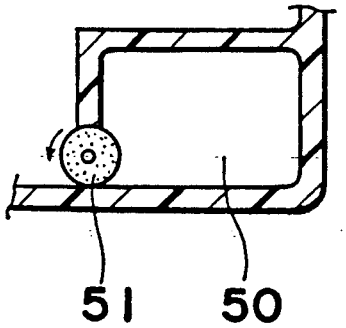
FIGS. 18 to 22 are fragmentary side sections showing other embodiments of the collecting section.
Figure 19:
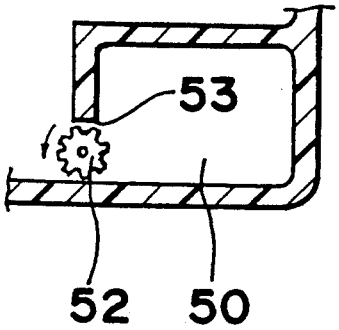
Figure 20:
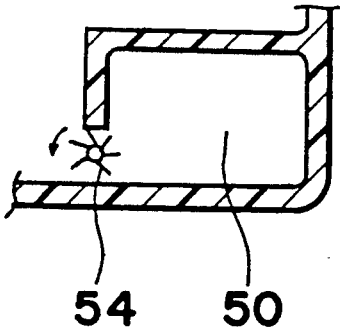
Figure 21:
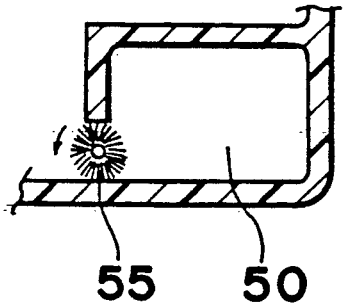

In the foregoing embodiments, although the collecting screw is employed as the means for collecting the toner at the supply section, such collecting screw may be replaced, for example, by a roller 51 made of Moltopren (name used in trade and manufactured by Bayer Co.) (FIG. 18), a hard roller 52 having axial grooves (FIG. 19), a blade member 54 having a plurality of elastic films of Mylar (name used in trade and manufactured by Du Pont) or the like, or vanes made of metallic sheets, for example, of phosphor bronze, ribbon steel or stainless steel or the like which are arranged in the circumferential direction (FIG. 20), or a brush member 55 (FIG. 21). In the arrangement of FIG. 19, a scraping plate 53 is provided on the housing to scrape off the toner filled in the grooves of the roller 52. In the respective diagrams in FIGS. 18 to 21, the collecting section is represented by a numeral 50.

Figure 22:
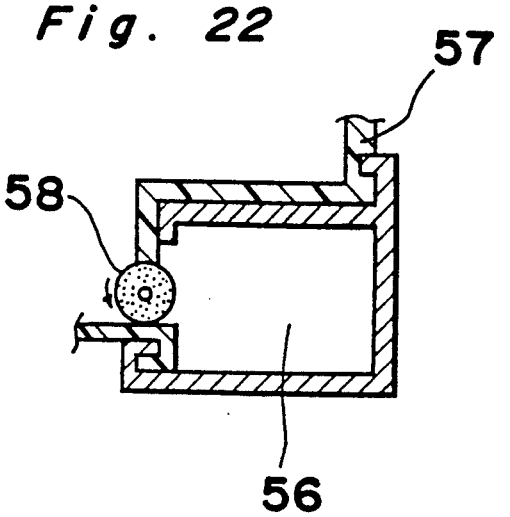

In another modification, a collecting section 56 may be detachably mounted on a housing 57 of the developing apparatus as shown in FIG. 22, with a collecting roller 48 being provided for the toner collecting means.

Furthermore, in the foregoing embodiments, although the collecting screw is arranged to be rotated in synchronization with the toner supply roller or developing roller, the arrangement may be so modified, for example, that the toner is collected for each copying or intermittently per the predetermined number of copied sheets.

In the foregoing embodiments, the toner collecting rate is set to be 10% of the toner accommodated in the toner hopper, but the image quality may be still more improved through further reduction of the average particle size of the toner to be used for developing if the collecting rate is raised.

As is seen from the foregoing description, in the developing apparatus according to the above embodiments, since the collecting means for collecting toner in the supply section is provided so as to properly collect the toner in said supply section, toner having smaller average particle diameter than the toner at the filling thereof into the toner hopper, may be stably fed for the developing.

Accordingly, images clear and definite at the edge portions and narrow lines can be obtained under a stable state.

Moreover, since the toner with small particle diameters is high in the electrical charge mount, it is less likely to be spilt out of the developing apparatus, and the interior of the image forming apparatus incorporated with the developing apparatus may be maintained in a clean state.

VIII. 9th embodiment

Figure 23:
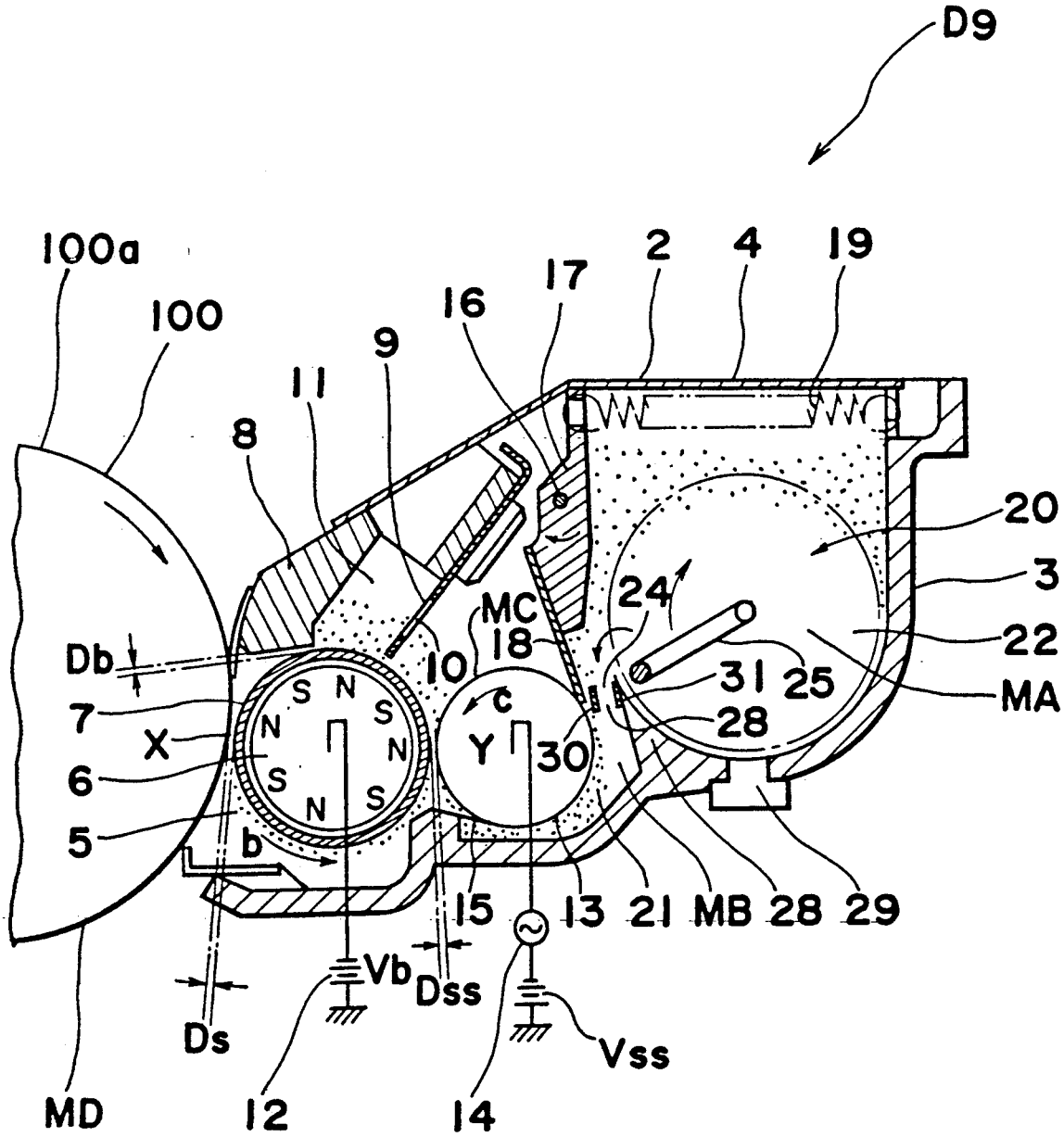
FIG. 23 is a schematic side sectional view of a developing apparatus according a ninth embodiment of the present invention.

In FIG. 23, there is shown a developing apparatus D9 which is a modification of the developing apparatus D1 described earlier with reference to FIG. 1. In the arrangement of FIG. 23, since the parts represented by the numerals 1 to 25 are the same as those in the developing apparatus D1 in FIG. 1, detailed description thereof is abbreviated here for brevity.

In addition to the constituting parts 1 to 25 in the developing apparatus D1 in FIG. 1, the developing apparatus D9 of FIG. 23 further includes a toner detecting device 28 having a set of spaced electrodes 30 and 31 arranged to confront each other along the restricting blade 18 in the vicinity of the opening for the supply section 21, thereby to measure electrostatic capacity across said electrodes, with toner located between the electrodes 30 and 31 being utilized as a dielectric material, and a pressure sensor 29 provided below the toner hopper 20 so as to measure the weight of the toner accommodated in the replenishing section 22.

In the developing apparatus D9 having the construction as described above, the amount of toner at the replenishing section 22 is measured by the pressure sensor 29, and when it becomes necessary to replenish the toner, with the toner amount thereat being reduced below a predetermined reference amount, "toner empty" is notified based on the result of measurements by the pressure sensor 29.

When the toner is replenished into the replenishing section 22, the state of "toner empty" is eliminated, and the toner having the constant particle diameter may be continuously supplied for the developing.

Moreover, in the case where the crosslinking of toner takes place above the opening 24, thereby to cut off the replenishment of toner to the supply section 21, since the presence of toner in the replenishing section 22 has been detected by the pressure sensor 29, such a state can not be detected by the output of said pressure sensor 29. However, in the above case, if a hollow portion without toner is formed in the vicinity of the opening 24, the electrostatic capacity across the electrodes 30 and 31 is varied through reduction of the amount of toner present between said electrodes 30 and 31, whereby the suspension of toner supply t the supply section 21 by the crosslinking phenomenon of the toner is detected, and such crosslinking phenomenon is eliminated by applying impacts to the developing apparatus D9 by a vibrating means, etc.

Subsequently, by driving the developing apparatus D9 shown in FIG. 23, variation of toner particle diameters was investigated at the measuring points through experiments as described below, with the developing apparatus being set in the conditions as follows.

* Measuring point MA . . . Replenishing section 22
* Measuring point MB . . . Supply section 21
* Measuring point MC . . . Surface of the toner supply roller 13 passing through the forward edge of the restricting blade 18.

* Measuring point MD . . . Surface of the photoreceptor drum 100 passing through the developing region X.

| Conditions for experiments | |
|---|---|
| (a) Developing sleeve (7) | |
| Diameter | 24.5 mm |
| Revolution | 200 rpm |
| Developing bias (Vb) | DC-200 V |
| (b) Toner supply roller (13) | |
| diameter | 20 mm |
| Revolution | 200 rpm |
| Collecting bias (Vss) | DC-400 V<br>AC 700 Vrms |
| AC frequency | 300 Hz |
| Surface roughness | 40 μm |
| (c) Gap | |
| Developing gap (Ds) | 0.6 mm |
| Bristle height restrict. height (Db) | 0.45 mm |
| Supply gap (Dss) | 0.8 mm |
| (d) Restricting blade (18) | |
| Material Stainless Steel | |
| Thickness | t = 100 μm |
| Pressure contact force | 0.1 g/mm |
| (f) Toner | |
| Ave. particle dia. at filling | 14 μm |

Figure 24:
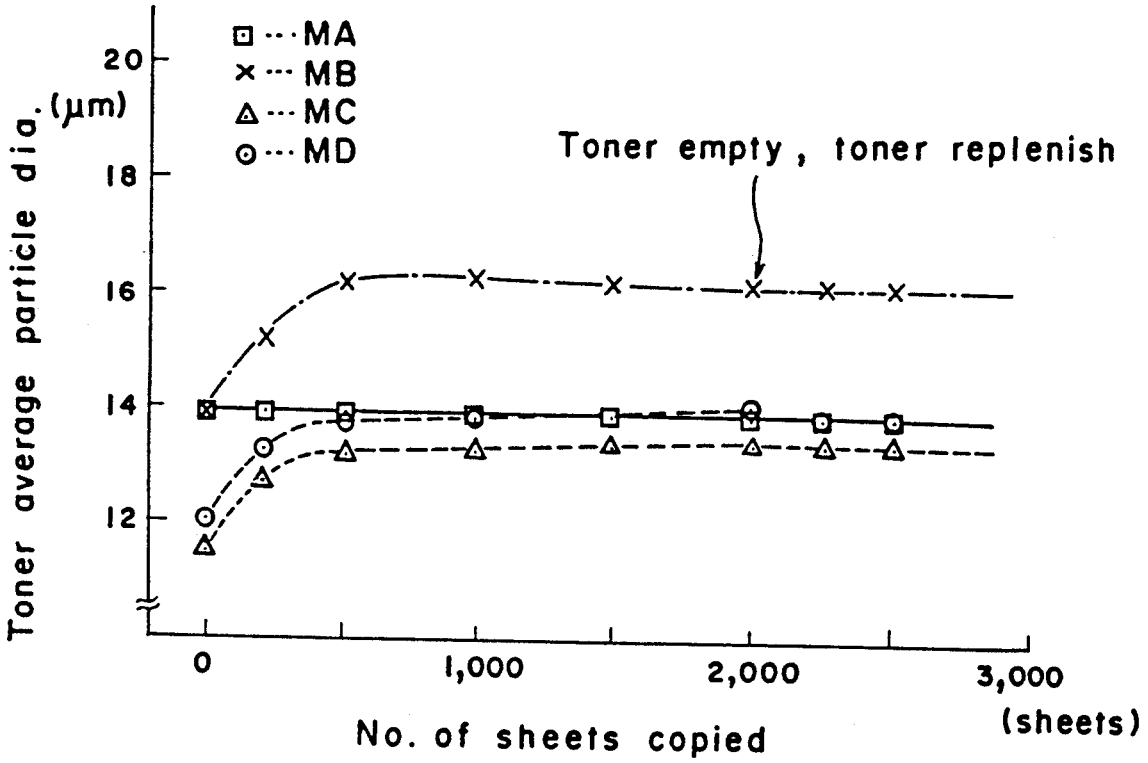
FIGS. 24 and 25 are characteristic diagrams showing relations between the number of copied sheets and toner average particle diameters.

As a result of the experiment, as shown in FIG. 24, the average particle diameter of toner at the replenishing section 22 (measuring point MA) is maintained to be the average particle diameter of 14μm at the filling, irrespective of the number of copied sheets. Although the average particle diameter at the supply section 21 (measuring point MB) was generally increased up to the number of copied sheets of about 500, it was almost stabilized thereafter at about 16.2μm. On the surface of the photoreceptor drum 100 (measuring point MD) and the surface of the toner supply roller 13 (measuring point MC), although the average particle diameter was small at the initial stage, with the toner being preferentially supplied from the small particle diameter toner, increase of the particle diameter is stopped at the same time as the average particle diameter at the supply section 21 (measuring point MB) is brought into the stabilized state, and the progress for the larger particle diameter was almost stopped at the average particle diameter of 14μm during filling of toner at the measuring point MD, and at the average particle diameter of 13.7μm at the measuring point MC.

Thus, at the time point for the number of copied sheets of 2,000, "toner empty" was notified by the pressure sensor 29, and when toner was replenished to the replenishing section 22 at this time, the state up to that time was continuously maintained, and the toner with the average particle diameter of 14μm was stably supplied for the developing.

Figure 25:
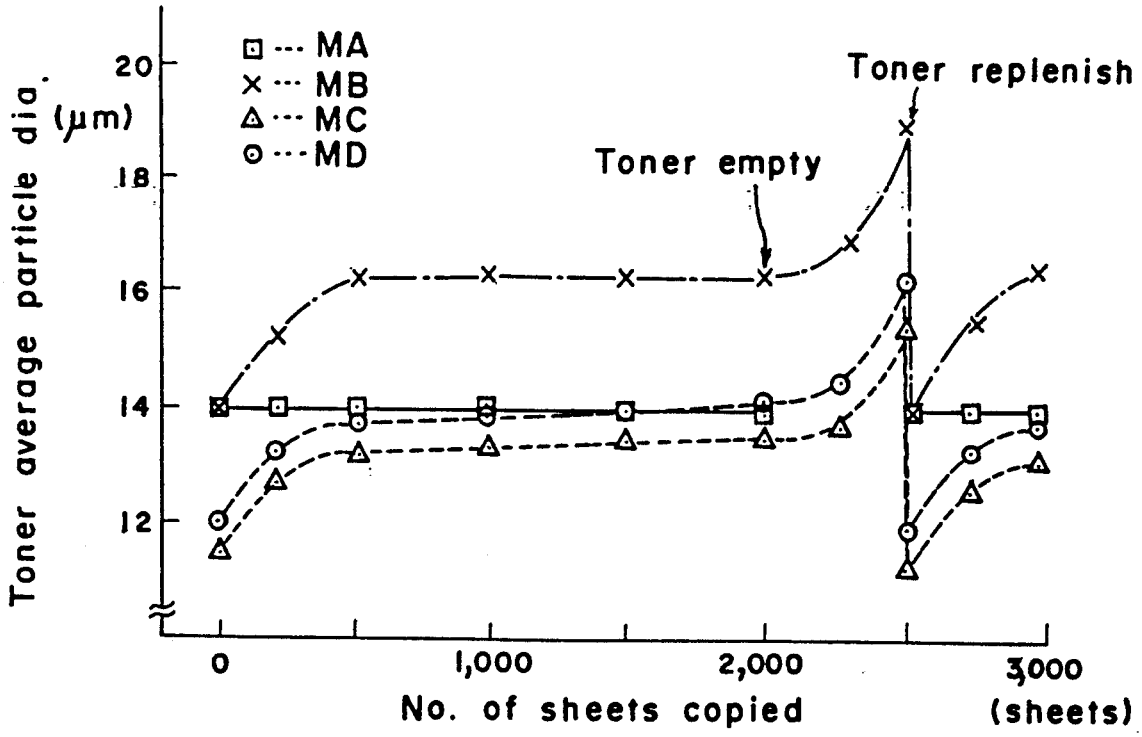

On the other hand, in the case where the copying function is continued by consuming the toner in the supply section 21 even when the replenishing section 22 is brought into the state of "toner empty", as shown in FIG. 25, the average particle diameter of toner in the supply section 21 is gradually increased when the toner supply to the replenishing section 22 is suspended, and at the time point for the number of copied sheets of 2,500 at which the toner of the supply section 21 was almost used up, the average particle diameter of the toner in the supply section 21 reached 18.8μm.

Meanwhile, along with the increase of the average particle diameter of toner at the supply section 21, the average particle diameter on the surface (measuring point MC) of the toner supply roller 13, and that on the surface (measuring point MD of the photoreceptor drum 100 is increased, and at the time point for the number of copied sheets of 2,500, the average particle diameter on the surface (measuring point MD) of the photoreceptor drum 100 reached 16.2μm, and that on the surface (measuring point MC) of the toner supply roller 13 was increased up to 15.4μm.

Moreover, copied images were deteriorated in the image quality as the average particle diameter of the toner supplied as the average particle diameter of the toner supplied for the developing became larger, and in the image at the time point for the number of copied sheets of 2,500, fogging in the ground was conspicuously observed, with the grains of the image becoming very coarse.

Subsequently, when the developing is again started, with fresh toner being replenished into the supply section 21 and the replenishing section 22 at the time point when the developing for the number of copied sheets of 2,500 was completed, the toner average particle diameters at the respective measuring points returned to the same state as in the starting of copying.

However, fogging in the ground is still noticed in the copied image, and the image quality was not improved.

The above phenomenon may be attributable to the fact that, at the time point when toner is replenished, the toner remaining in the supply section 21 and the toner newly replenished are charged to opposite polarities to each other due to the difference in the average particle diameters or variation o electrical charging characteristics through separation of an after-treating agent applied over the surface of the remaining toner by stirring, and the toner charged to the polarity opposite to that in the normal state is applied to the developing as it is, thereby showing the undesirable fogging in the background portion.

It should be noted here that, although such phenomenon is taking place at all times even up to the number of copied sheets of 2,000, since the toner replenishment to the supply section 21 is effected little by little in the amount so as to correspond to the consumption, and in the state where toner is filled up in the supply section 21, the toner charged in the opposite polarity is properly dispersed as it is stirred, such toner does not conspicuously appear as fogging on the image.

IX. 10th embodiment

Figure 26:
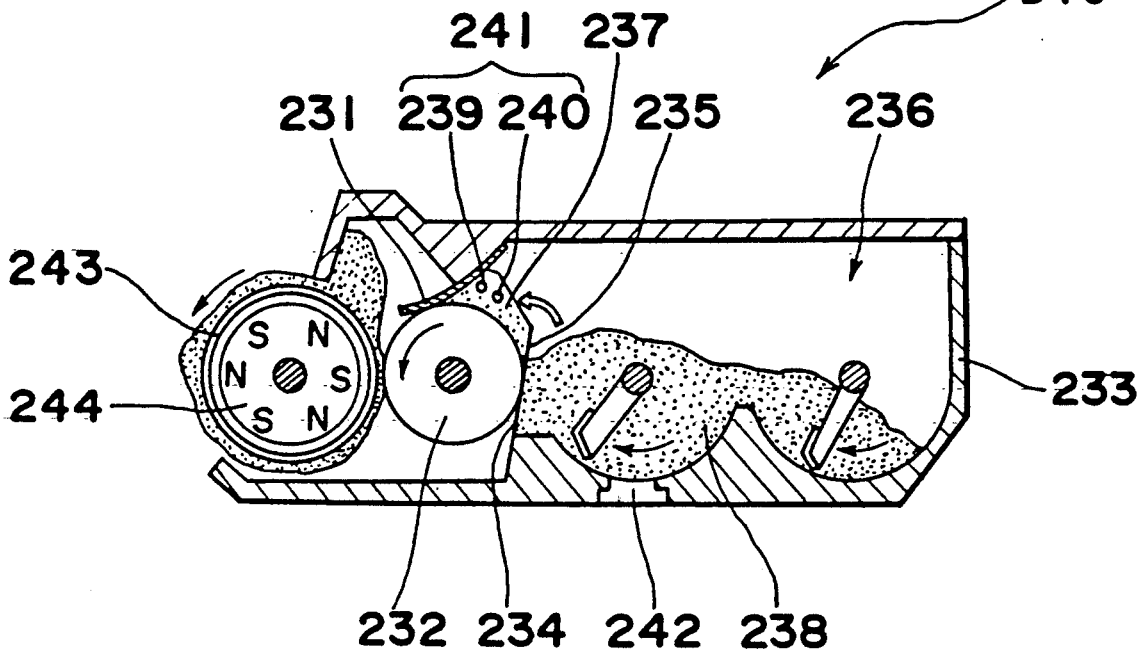
FIGS. 26 and 27 are schematic side sectional views of developing apparatuses according to tenth and eleventh embodiments of the present invention.

In FIG. 26 there is shown a developing apparatus D10 according to a tenth embodiment of the present invention, which is intended to use a two-component developing material similar to the developing apparatus D9 as explained above.

The developing apparatus D10 in FIG. 26 also includes a housing 233 in which a toner hopper 236 is defined, and a developing sleeve 243 in which a magnet member 244 is incorporated, and a toner supply roller 232 which are disposed in the housing 233. In the above developing apparatus D10, the forward edge of a restricting blade 231 is pressed against the surface of the toner supply roller 232 along the rotating direction of said roller, while a restricting member 234 provided on the bottom portion of the housing 233 is also held in pressure contact with the rear side face of the roller 232. The restricting member 234 is extended upwardly to form a partition wall 235, which divides the interior of the toner hopper 236 into a supply section 237 and a replenishing section 238. In the supply section 237, a toner detecting device 241 composed of a set of electrodes 239 and 240 similar to the detecting device 28 as employed in the developing apparatus D9 is provided, with a pressure sensor 242 being disposed at the bottom of the replenishing section 238.

Accordingly, in the developing apparatus D10 also, "toner empty" in the replenishing section 238, and faulty replenishment of toner to the supply section 237 by the crosslinking phenomenon of toner, etc. may be detected in the similar manner as in the developing apparatus D9 of FIG. 23, thereby achieving stabilization of image quality over a long period.

X. 11th embodiment

Figure 27:
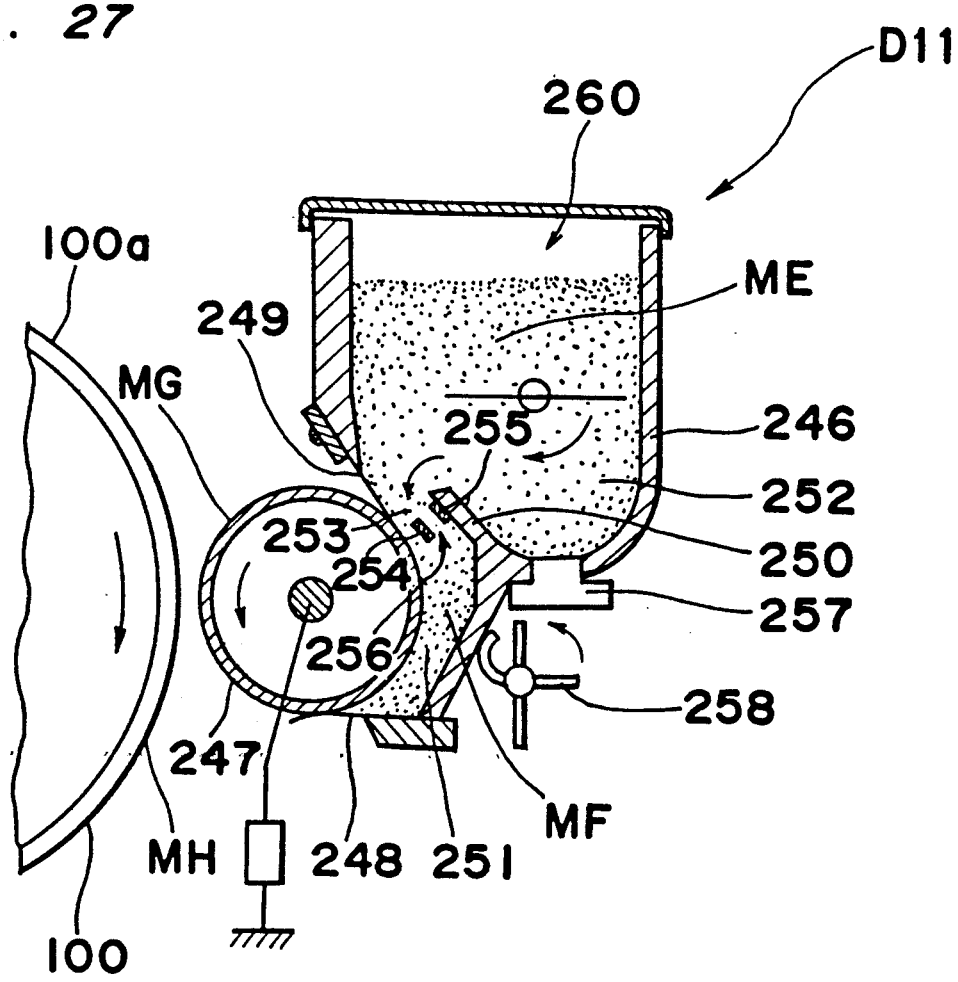

Another developing apparatus D11 shown in FIG. 27 is intended to use a mono-component developing material.

The developing apparatus D11 also includes a housing 246 in which a toner hopper 260 is defined, a developing roller 247 provided at the lower opening of the housing 246, a toner leakage preventing member 248 and a restricting blade 249 held in pressure contact with the outer peripheral surface of the developing roller 247, a partition wall 250 formed by extending part of the frame of the housing 246 up to the rear portion of said restricting blade 249 so as to divide the interior of the toner hopper 260 into a supply section 251 and a replenishing section 252, a toner detecting device 256 composed of a set of electrodes 254 and 255 and provided at an opening 253 for communicating the supply section 251 with the replenishing section 252, and a pressure sensor 257 provided at the bottom of the replenishing portion 252.

Figure 28:
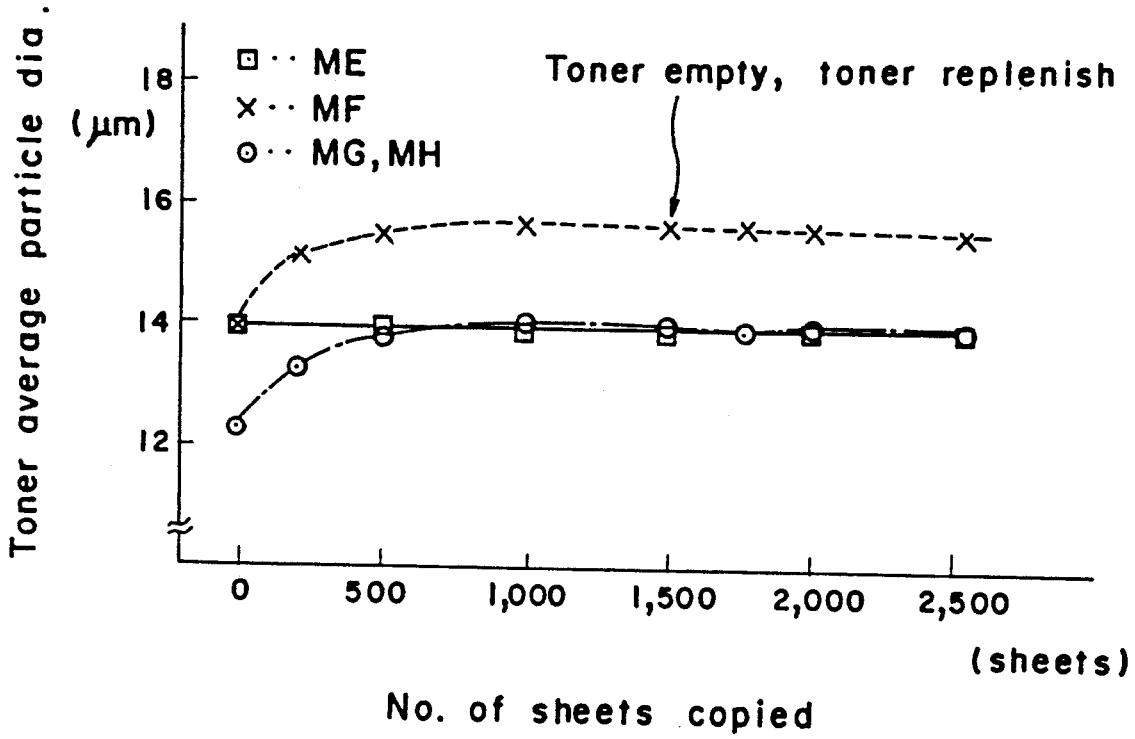
FIGS. 28 and 29 are characteristic diagrams showing relations between the number of copied sheets and toner average particle diameters.

When copying is effected, with toner being filled in the toner hopper 260 of the developing apparatus D11 as described above, as shown in FIG. 28, the toner average particle diameter at the replenishing portion 252 (measuring point ME) is maintained to be of 14μm at the filling from the initial stage of operation.

Meanwhile, the toner average particle diameter at the supply section 251 (measuring point MF) is gradually increased as the copying is started, and is stabilized at about 15.7μm in the number of copied sheets between 500 to 1,000. Moreover, on the developing roller 247 (measuring point MG) and the photoreceptor drum 100 (measuring point MH), the toner average particle diameter which was 1.4μm at the starting of the copying is gradually increased, and is stabilized at 14μm together with the particle diameter stabilization at the supply section 251.

Thus, at the time point for the number of copied sheets of 1,500, when toner was replenished to the replenishing section 252 which was brought into the state of "toner empty", the average particle diameters at the measuring point MF for the supply section 251, the measuring point MG for the developing roller 247, and the measuring point MH for the photoreceptor drum 100 were maintained to be in the state therebefore, and thus, images of a constant quality were obtained.

Figure 29:
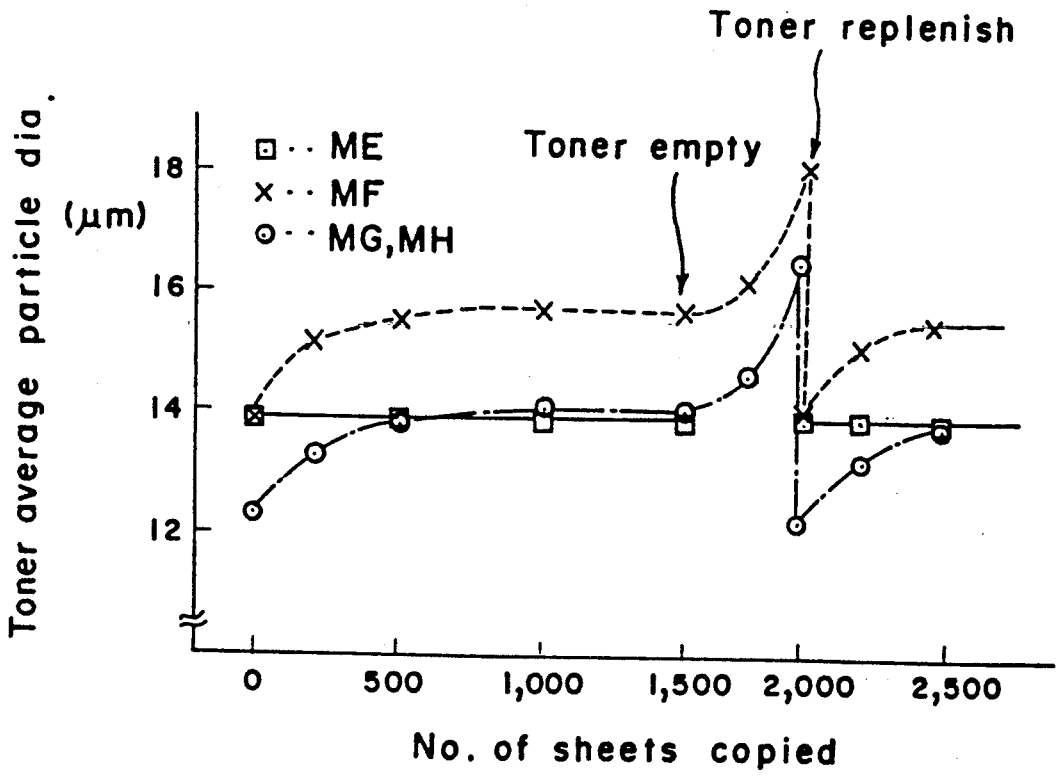

On the other hand, in the case where copying was continued by consuming the toner of the supply section 251 without replenishing toner even when the replenishing section showed the state of "toner empty", as shown in FIG. 29, the toner average particle diameter of the supply section 251 was rapidly increased, and at the time point of the number of copied sheets of 2,000, it reached 18.2μm. Meanwhile, at the measuring point MH for the photoreceptor drum 100 and the measuring point MG for the developing roller 247, the toner average particle diameter stabilized up to that time at 14μm was continuously increased, with the ground fogging gradually appearing on the image conspicuously, and at the time point of the number of copied sheets of 2,000, the toner average particle diameter was increased up to 16.6μm with the ground fogging also becoming considerably worse.

From the above state, when the toner is replenished to the replenishing section 252 and the supply section 251, although the toner average particle diameters at the respective measuring points returned to the initial stage at the starting of copying, the ground fogging was continuously noticed on the copied images even after the toner replenishment in the similar manner as in the previous embodiment.

Figure 31:
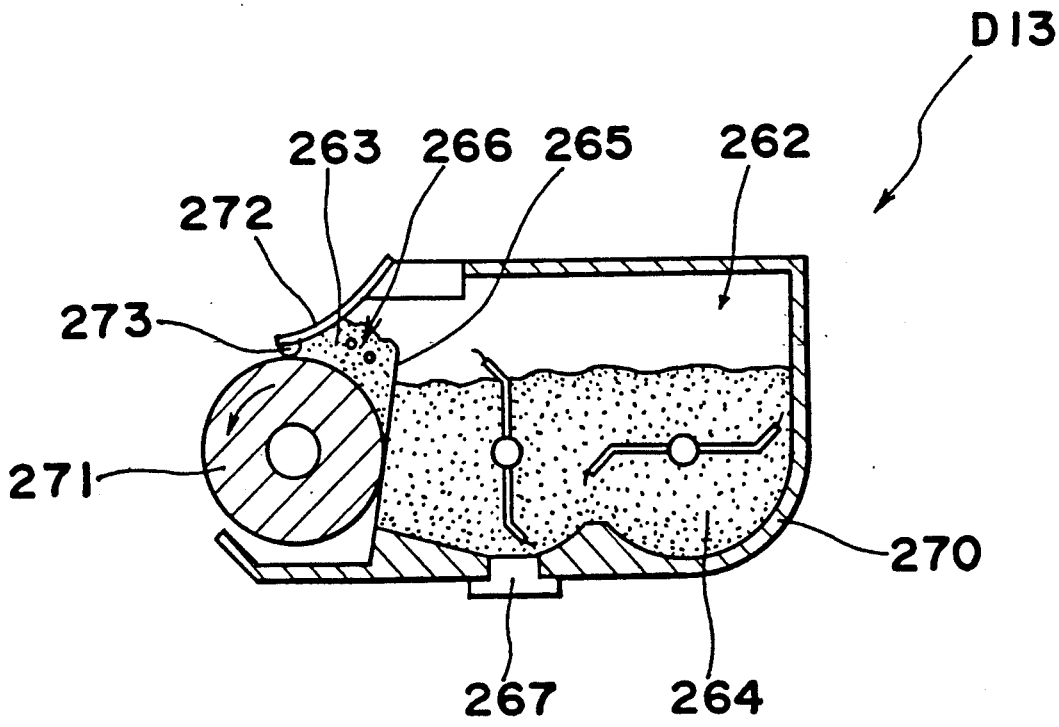
Figure 32:
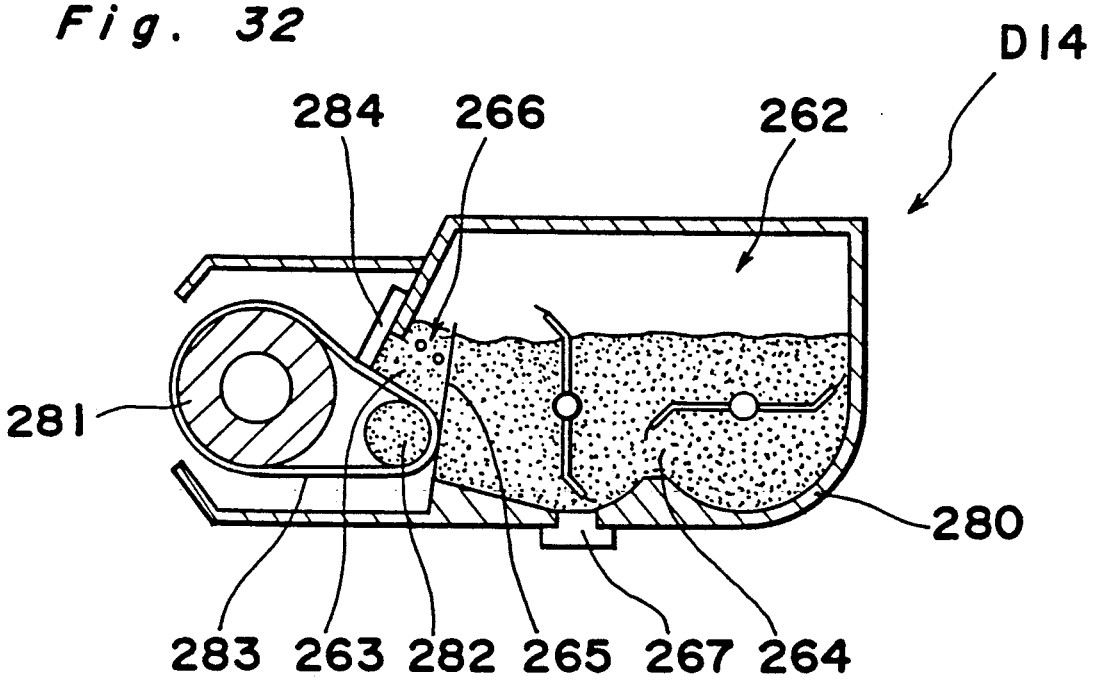

The above developing apparatus D11 further includes a vibrating means 258 having a plurality of blades or vanes and rotatably provided close to the bottom portion of the housing 246. The vibrating means 258 is arranged to be rotated at a very slow speed at all times, or to be rotated by a predetermined angle per a predetermined number of copying, or to be driven for rotation when the generation of the toner crosslinking was detected by the toner detecting device 256 so as to apply proper vibrations to the developing device D11 for removal of the toner crosslinking phenomenon or the like. XI. 12th to 14th embodiments Developing apparatuses D12 to D14 shown in FIGS. 30 to 32 are all intended to use the mono-component developing material, and each characterized in the toner support member and toner thin layer forming member.

Figure 30:
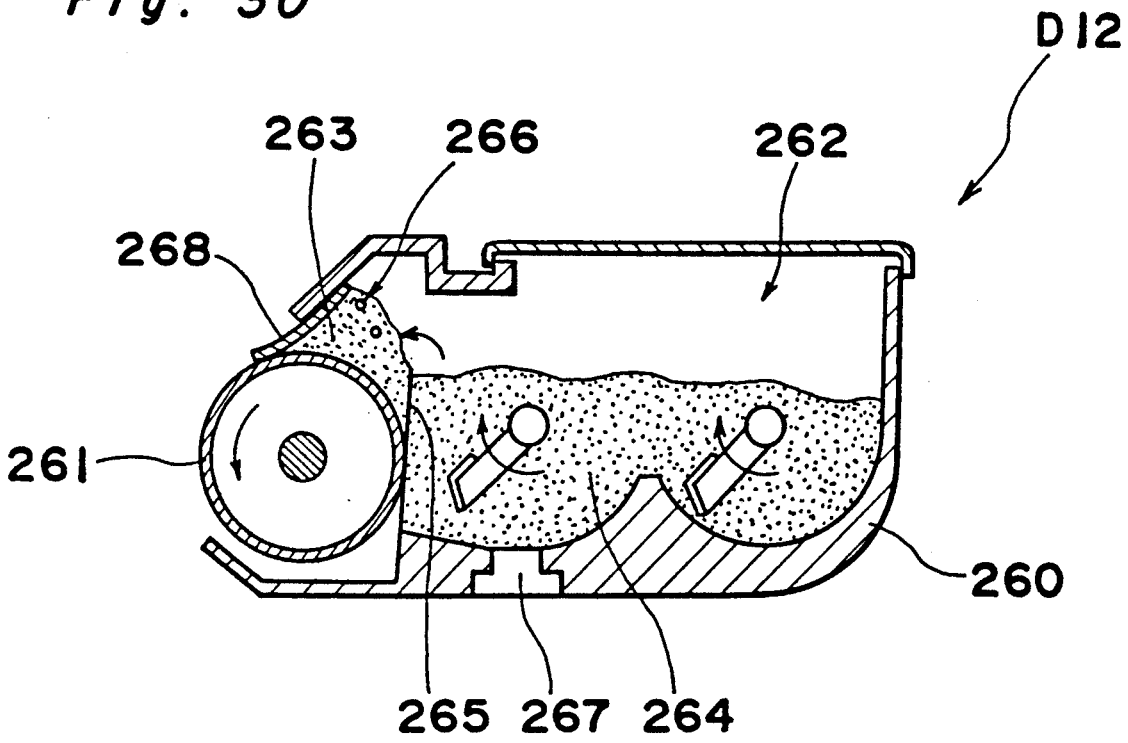
FIGS. 30 to 32 are schematic side sectional views of developing apparatuses according to twelfth to fourteenth embodiments of the invention.

In the developing apparatus D12 of FIG. 30, the forward edge of a restricting blade 268 made of an ordinary resilient material and provided on the apparatus housing 260 is pressed against the surface of a metallic roller 261 rotatably provided at an opening of the housing 260 of the apparatus D12. Meanwhile, in the developing apparatus D13 of FIG. 31, a contact member 273 having a semi-circular cross section and provided at the forward edge of a restricting blade 272 attached to the apparatus housing 270 is held in pressure contact with the surface of a resilient roller 271, for example, of a rubber material also rotatably provided a the opening of the housing 270. In the developing apparatus D14 of FIG. 32, the roller 261 or 271 in the embodiment of FIG. 30 or 31 is replaced by a roller and belt arrangement including an endless belt 283 made of metal, synthetic resin, etc, passed around two rollers 281 and 282, with the forward edge of a restricting blade 284 provided on the apparatus housing 280 being directly pressed against the surface of said endless belt 283.

In each of the developing apparatuses D12 to D14, the hopper 262 is defined within the apparatus housing 260, 270 or 280, which is divided into the supply section 263 and the replenishing section 264 by the partition wall 265, and in the supply section 263, the toner detecting device 266 having a pair of electrodes in the similar manner as described earlier with reference to the embodiment of FIG. 23, etc. is provided, with the pressure sensor 267 being disposed at the bottom of the apparatus housing.

It is to be noted here that, in the developing apparatuses D12, D13 and D14 as described above, although the toner detecting means having the set of electrodes and pressure sensor is employed, such toner detecting means is not limited to this type alone, but may be replaced by detecting means of other types so far as they are suitable for the purpose.

As is seen from the above description, in the developing apparatuses D12, D13 and D14, the toner detecting means is provided in each of the supply section and the replenishing section formed by partitioning the interior of the toner hopper so as to detect the toner amount in the replenishing section, and also, the faulty toner replenishment to the supply section due to crosslinking phenomenon of toner to be produced within the toner hopper.

Accordingly, toner is continuously supplied to the supply section from the replenishing section, while approximately a predetermined amount of toner is accommodated within the supply section at all times, and therefore, toner having constant particle diameters may be stably supplied, thereby to continuously provide images of a predetermined quality.

XII. 15th embodiment

Figure 33:
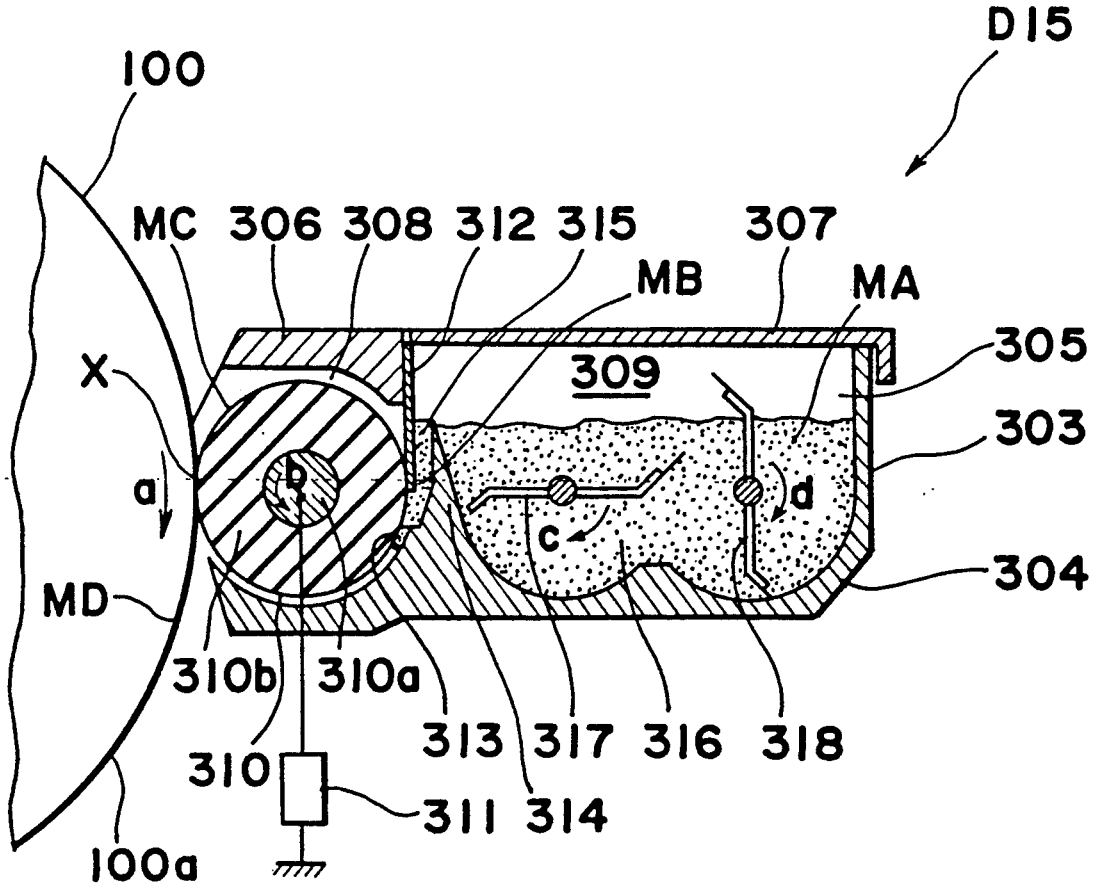
FIG. 33 is a schematic side sectional view of a developing apparatus according a fifteenth embodiment of the present invention.

Referring further to FIG. 33, there is shown a developing apparatus D15 according to fifteenth embodiment of the present invention which employs a monocomponent developing material.

The developing apparatus D15 includes a housing 303 which is divided into a developing section 308 located at the side of the photoreceptor drum 100, and a toner hopper 309 defined at the rear side of the developing section 308, and a developing roller 310 rotatably provided within said developing section 308.

More specifically, the housing 303 of the developing apparatus D15 is constituted by a bottom casing 304, side casing 305 (only one side casing 305 is shown in FIG. 33), an upper casing 306, and an open/close cover 307.

In the developing section 308, the developing roller 310 formed by externally applying a resilient roller 310*b* of a rubber material or the like onto a metallic shaft 310*a* is disposed for rotation, with its peripheral surface being held in contact with the corresponding outer surface 100*a* of the photoreceptor drum 100, and the shaft 310*a* is applied with a developing bias from a power supply 311. A restricting blade 312 attached to he upper casing 306 is held in pressure contact, at its forward edge, with the outer peripheral surface at the rear side of the developing roller 310, while a toner leakage preventing pad 313 is disposed between th developing roller 310 and the bottom casing 304. With the toner hopper 309, a partition wall 314 is formed by extending part of the bottom casing 304 up to generally a central portion of the restricting blade 312 in height so as to divide the internal space of toner hopper 309 into a supply section 315 and a replenishing section 316, with the supply section 315 being made small as compared with the replenishing section 316. In the replenishing section 316, stirring blades 317 and 318 are disposed.

Figure 34:
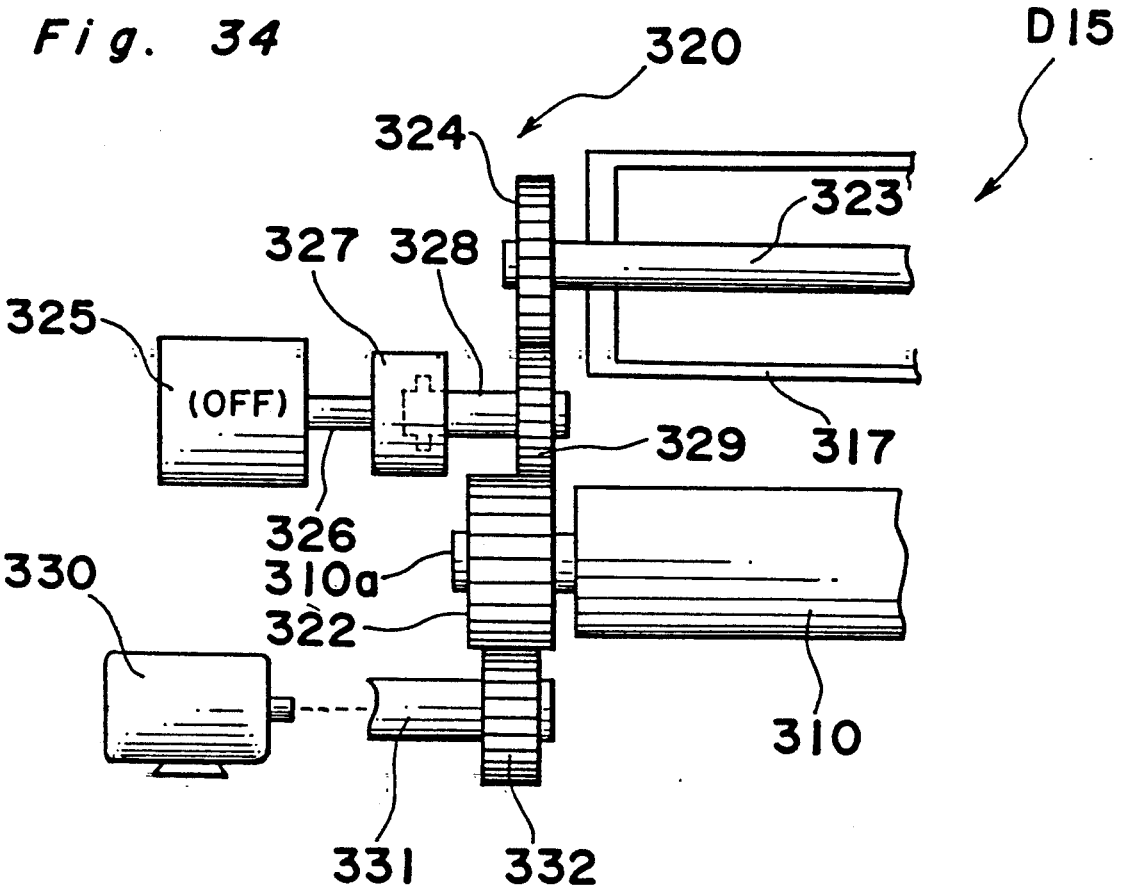
Figure 35:
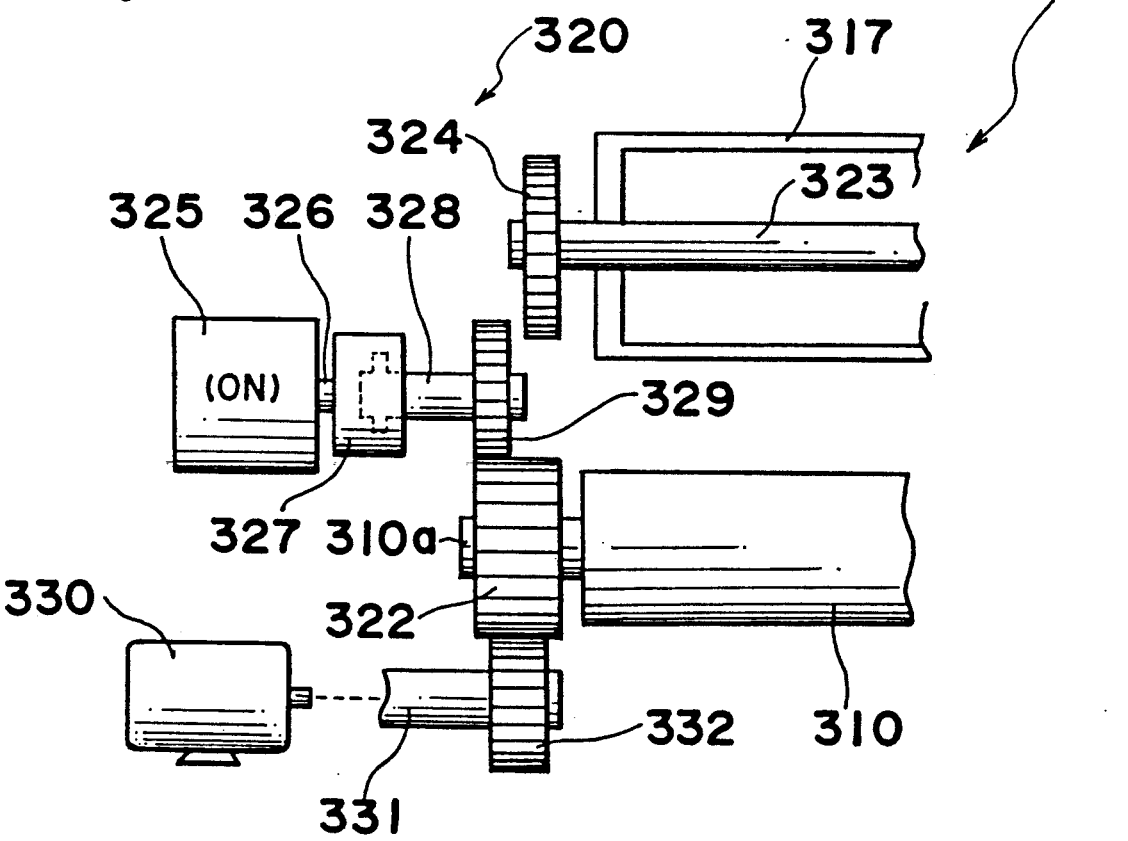
FIGS. 35 are fragmentary top plan views for explaining functions of a driving device employed in the arrangement of FIG. 33.

In FIGS. 34 and 35, the state of operation of a driving device 320 for the developing roller 310, and the stirring blades 317 and 318 is shown.

In the driving device 320, gears 322 and 324 are respectively fixed to the shaft 310*a* of the developing roller 310 and a shaft 323 of the stirring blade 317. An idle gear 329 is engaged with a gear 322 of the developing roller 310, while said idle gear 329 and its support shaft 328 is rotatably connected to a connecting portion 327 fixed to the plunger 326 of a solenoid 325. Thus, when the solenoid 325 is in the off state, plunger 326 thereof is in a push state as shown in FIG. 34, with the idle gear 329 engaged with the gear 324 of the stirring blade 317. It is to be noted that the stirring blade 317 is arranged to be rotated in synchronization with the stirring blade 318 through a gear (not shown). Meanwhile, when the solenoid 325 is turned on, the plunger 326 is in a pull state as shown in FIG. 35, and the gear 329 is disengaged from the gear 324 of the stirring blade 317. Moreover, the gear 322 of the developing roller 310 is engaged with a gear 332 fixed to a driving shaft 331 coupled with a main motor 330.

Figure 36:
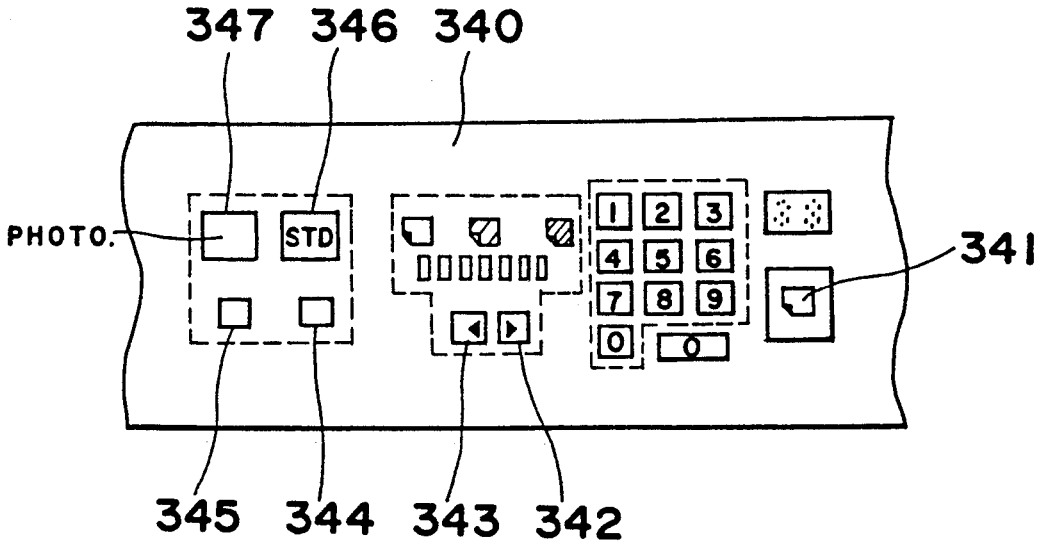
FIG. 36 is a fragmentary top plan view of a control panel employed in an image forming apparatus to which the present invention may be applied.

In FIG. 36, there is shown part of a control panel 340 for an image forming apparatus (not particularly shown) to which the developing apparatus of the present invention may be applied.

On the control panel as shown in FIG. 36, there are provided a start key 341 for instructing printing, an up key 342 and a down key 343 for adjusting image density, a standard mode key 344 and a photographic mode key 345 for designating the image quality of the image to be formed, to the standard mode or the photographic mode, a standard mode display lamp 347 for displaying the image quality mode as selected.

Figure 37:
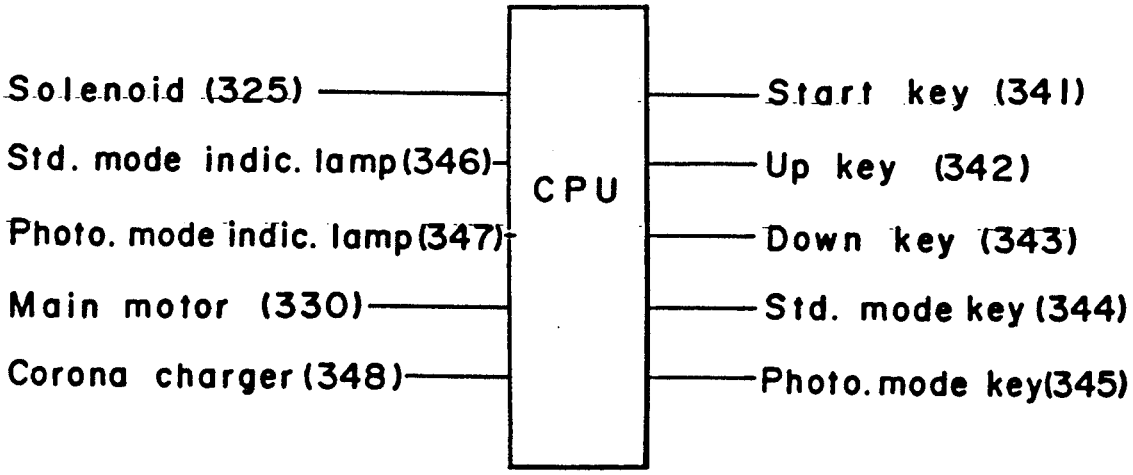
FIG. 37 is a schematic diagram showing part of a control circuit for the image forming apparatus.

It is to be noted that the keys 341 to 345 referred to above respectively have corresponding switches to be turned on through depression of these keys, and as shown in FIG. 37, ON signals emitted thereby are arranged to be inputted to a control unit CPU (central processing unit). Furthermore, it is so arranged that the lamps 356 and 347 in FIG. 36, and the solenoid 325, the main motor 330, and also, a corona charger 348 (not shown in FIG. 36) in FIG. 37 are turned on or off by signals from the control unit CPU.

It should be noted here that the standard mode represents a mode for producing a contrast image, attaching importance to reproduction of line images at a low density, while the photographic mode denotes a mode for preparing a soft image strongly emphasizing contrast of a half tone.

The function of the image forming apparatus having constructions as described above will be explained with particular reference to the function of the developing apparatus D15.

In the image forming apparatus, when a main switch (not shown) is turned on, the standard mode is automatically selected, and in the driving device 320, the solenoid 325 is de-energized so as to be set in the push state (i.e. the state shown in FIG. 34).

In the above state, when the start key 341 is depressed, the corona charger 348 is turned on, and the photosensitive surface 100*a* of the photoreceptor drum 100 rotated in the direction of the arrow a is charged to a predetermined potential, and thereafter, exposed to image light through an optical system (not shown) so as to be formed thereon with an electrostatic latent image.

Meanwhile, in the driving device 320, the rotation of the main motor 330 is successively transmitted to the gears 332, 332, 329 and 324, and the developing roller 310, and the stirring blades 317 and 318 are respectively driven for rotation in the directions indicated by arrows b,c, and d in FIG. 33.

Accordingly, in the developing device D15, the toner in the supply section 315 contacting the developing roller 310 is supported on the outer periphery of said developing roller so as to be transported in the direction of the arrow b, and is restricted by the forward edge of the restricting blade 312 s that an excessive amount of the toner is scraped off therefrom.

The toner still supported on the surface of the developing roller 310 and passing through the forward edge of the restricting glade 312 is imparted with electrical charge upon contact with said blade 312 as it passes therethrough, and this charged toner electrostatically adheres to the electrostatic latent image on the surface 100*a* of the photoreceptor drum 100 so as to visualize said latent image into a visible toner image based on a potential difference between the potential of the latent image and the developing bias at the contact portion (developing region X) between the developing roller 310 and the photosensitive surface 100*a* of the photoreceptor drum 100.

The toner image thus prepared is transferred onto a transfer material such as paper or the like at a transfer process (not shown), and is further fused and fixed onto the transfer material at a fixing process (not shown).

The toner which has passed through the developing region X further passes through between the surface of the developing roller 310 and the toner leakage preventing pad 313 so as to appear at the supply section 315 again, where toner corresponding in amount to the toner consumed at the developing region X is supplied.

By the repetition of the developing in the above described manner, the toner at the supply section 315 is consumed, and toner corresponding in amount to the consumed toner is replenished from the republishing section 316 to the supply section 315 based on rotation of the stirring blades 317 and 318.

It is to be noted here that, in the toner accommodated in the supply section 315 and the replenishing section 316, large particle diameter toner and small particle diameter toner are normally contained at a predetermined percentage, and toner having smaller particle diameter is more probably supported on the surface of the developing roller 310 at a higher probability, while toner having larger diameter is more likely to be restricted by the forward edge of the restricting blade 312 so as to be scraped off thereby.

Figure 39:
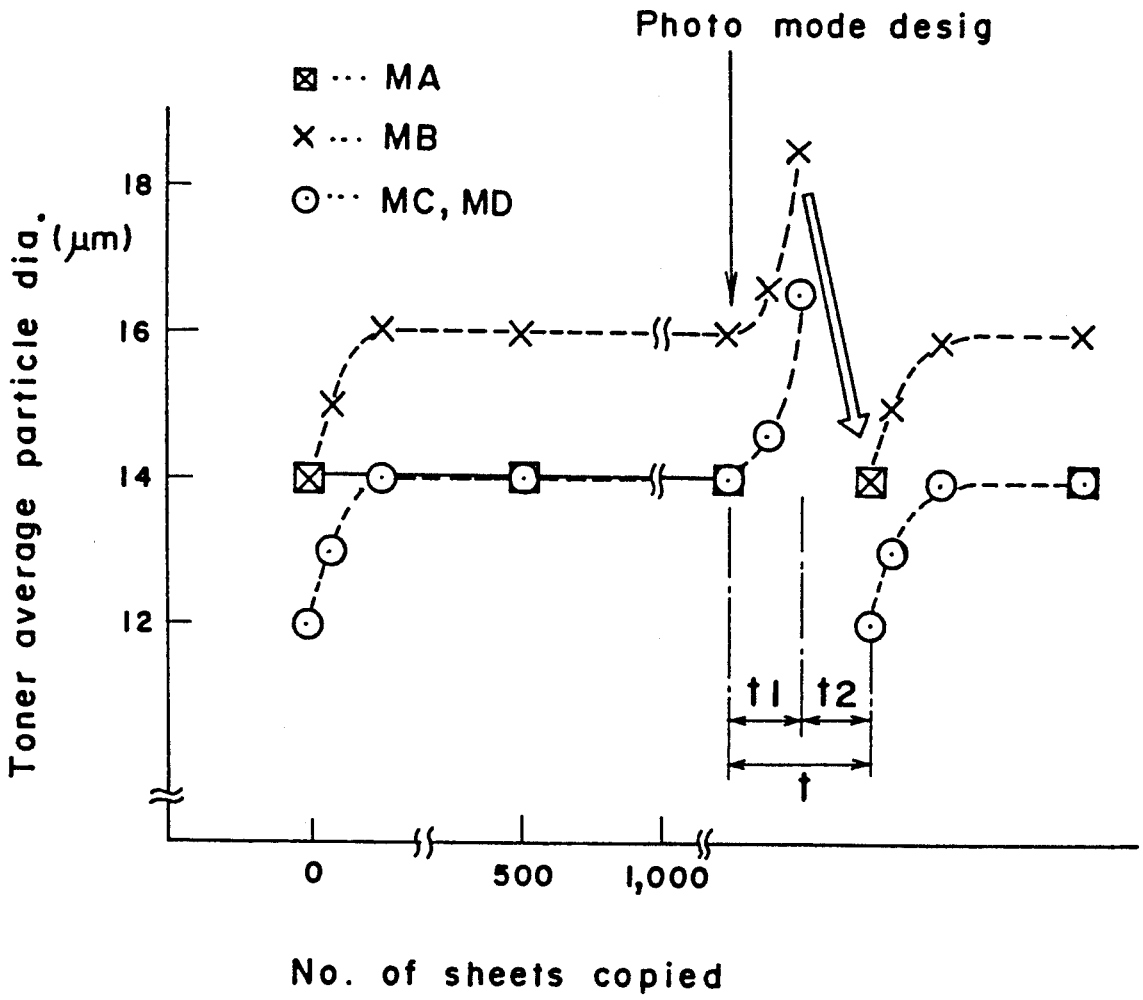
FIG. 39 is a diagram showing variations in the average particle diameters of toner at various parts of the developing apparatus.

Accordingly, as shown in FIG. 39, when copying is effected, with toner (with average particle diameter of 14μm) being charged in the toner hopper 309 in the empty state, the average particle diameters at respective parts were varied as follows.

More specifically, the toner average particle diameter at the replenishing section 316 (measuring point MA) is maintained to be that at the filling 14μm irrespective of the number of copied sheets.

However, at the supply section 315 (measuring point MC), the toner average particle diameter was gradually increase, since the toner is consumed from the toner having small particle diameters, while the toner average particle diameters at the measuring points MC and MD which were initially small at about 12μm, are also increased. Thus, when the toner average particle diameters at the measuring points MC and MD become equal to the average particle diameter of the toner fed from the replenishing section 316 to the supply section 313, the average particle diameter of the toner at the supply section 315 (measuring point MB) is stabilized, and thereafter, toner with the constant particle diameter, i.e. the toner having the average particle diameter as it is filled in the toner hopper 316 is supplied to the developing section 308.

Figure 38:
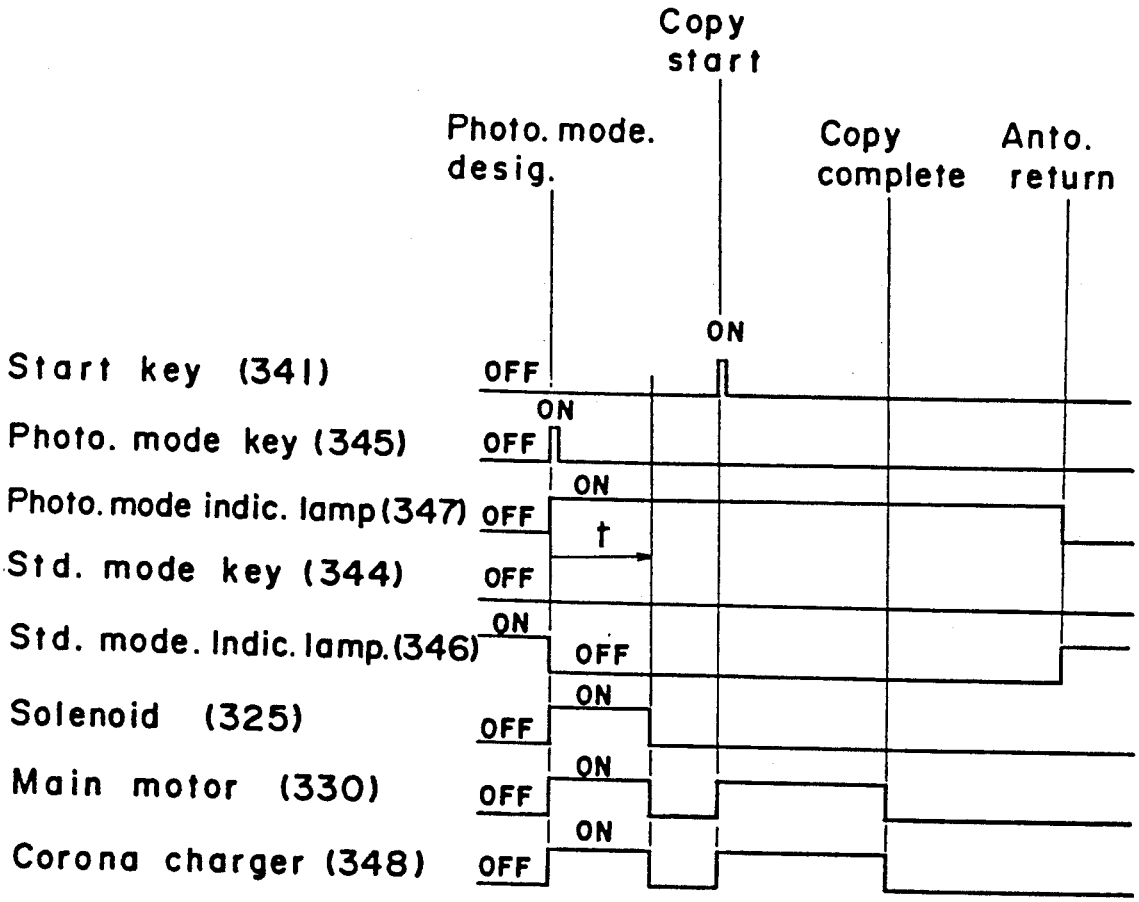
FIG. 38 is a time chart for explaining the state of functioning during selection of a photographic mode.

Subsequently, when the photographic mode key 345 is depressed for changing over the image quality mode from the standard mode to the photographic mode, the developing function is executed according to a time-chart as shown in FIG. 38.

As illustrated in FIG. 38, when the photographic mode key 345 is actuated, the photographic mode display lamp 347 is turned on, while the standard mode display lamp 346 illuminated up to that time is turned off to notify that the photographic mode has been selected.

Thus, the main motor 330 is turned on and the photoreceptor drum 100 is driven for rotation in the direction of the arrow a, while the corona charger 348 is turned on so as to impart a predetermined potential to the photosensitive surface 100*a* of the photoreceptor drum 100. In the driving device 320, the solenoid 325 is turned off and the plunger 326 is shifted into the "pull" state to disengage the idle roller 329 from the gear 314 (FIG. 35), and thus, only the developing roller 310 is rotated in the direction of the arrow b, with the stirring blades 317 and 318 maintained in the non-operating state.

As a result, in the developing apparatus D15, the developing is effected in the state where the toner replenishment from the replenishing section 316 is suspended, and the toner supported on the surface of the developing roller 310 at the supply section 315 is electrostatically fed, at the developing region X, to the electrostatic latent image, i.e. to the area applied with the charge by the corona charger 348, and the toner supplied onto the surface 100*a* of the photoreceptor drum 100 is all collected by a cleaning device (not shown).

As shown in FIG. 39, at the supply section 315 (measuring point MB), the toner average particle diameter is rapidly increased up to the time t1 at which the toner is consumed, and along with the above, the average particle diameter of the toner supplied to the developing section 308 (i.e. toner at measuring points MC and MD) is also increased.

Thereafter, when a time period represented by $t=t1+t2$ has elapsed, the main motor 330 is shut off, and the developing roller 310 stops rotation, while the corona charger 348 is de-energized. Additionally, the solenoid 325 is shifted to the push state (FIG. 34), and the gears 329 and 324 are engaged with each other, whereby the stirring blades 317 and 318 are set in the rotatable state.

Subsequently, when the copying function is started through depression of the start key 341, the main motor is again turned on, with corona charger 348 being energized.

By the above function, in the developing apparatus D15, the developing roller 310 and the stirring blades 317 and 318 ar rotated so as to replenish the toner within the replenishing section 316 into the supply section 315. Since the above replenished toner is supplied to the developing section 308, the toner having smaller particle diameters (average particle diameter of 12μm) in the toner supplied to the supply section 315, is to be supplied thereto as shown in FIG. 39.

Here, upon comparison of the images appearing on transfer materials when electrostatic latent images per unit area are developed by toner particles having large diameters, and toner particles having small diameters in the same number as the large diameter toner particles, owing to the fact that the toner particle of the small diameter naturally has a smaller occupying area per one particle than the toner particle of the large diameter, the image formed by the smaller diameter toner particles has a smaller toner projection area than the image formed by the larger diameter toner particles, with a consequent reduction in the image density.

The above fact implies that, when the smaller particle diameter toner is employed, even a slight difference in density in a high density image may be clearly represented as a difference in the number of distributed toner particles, thus providing an image superior in gradation.

Meanwhile, the grain of an image is determined by the number of distributed toner particles per unit area, and upon comparison of the image obtained by developing an electrostatic latent image per unit area with large diameter toner particles, and an image obtained by developing an electrostatic latent image per unit area with small diameter toner particles in the same number, the image by the small diameter toner particles has a grain finer than that of the image by the large diameter toner particles, with contours and narrow lines thereof being sharply reproduced.

Accordingly, the image developed by the small diameter toner particles as supplied from the supply section 315 is superior in the gradation, and also fine in the grain, with the contours and narrow lines represented clearly and definitely.

Subsequently, upon completion of the copying operation, the main motor 330 is shut off, and the photoreceptor drum 100 and developing roller 310, etc. are stopped, with the corona charger 348 turned off for standing-by for a predetermined period of time in the photographic mode, and if the start key 341 is not depressed during that period, the mode is automatically returned to the standard mode.

XIII: 16th embodiment

In FIGS. 40 to 43, there is shown a modification of the developing apparatus D15 in FIG. 33, with like parts in FIG. 33 being designated by like reference numerals.

In the modified developing apparatus D16 in FIGS. 40 to 43, a vertically movable partition wall 319 is further provided behind the developing roller 310 and the restricting blade 312 so as to divide the interior of the toner hopper 309 into the supply section 315 and the replenishing section 316, and also to completely shut off the communication between the supply section 315 and the replenishing section 316 by displacing said partition wall upwardly.

Figure 40:
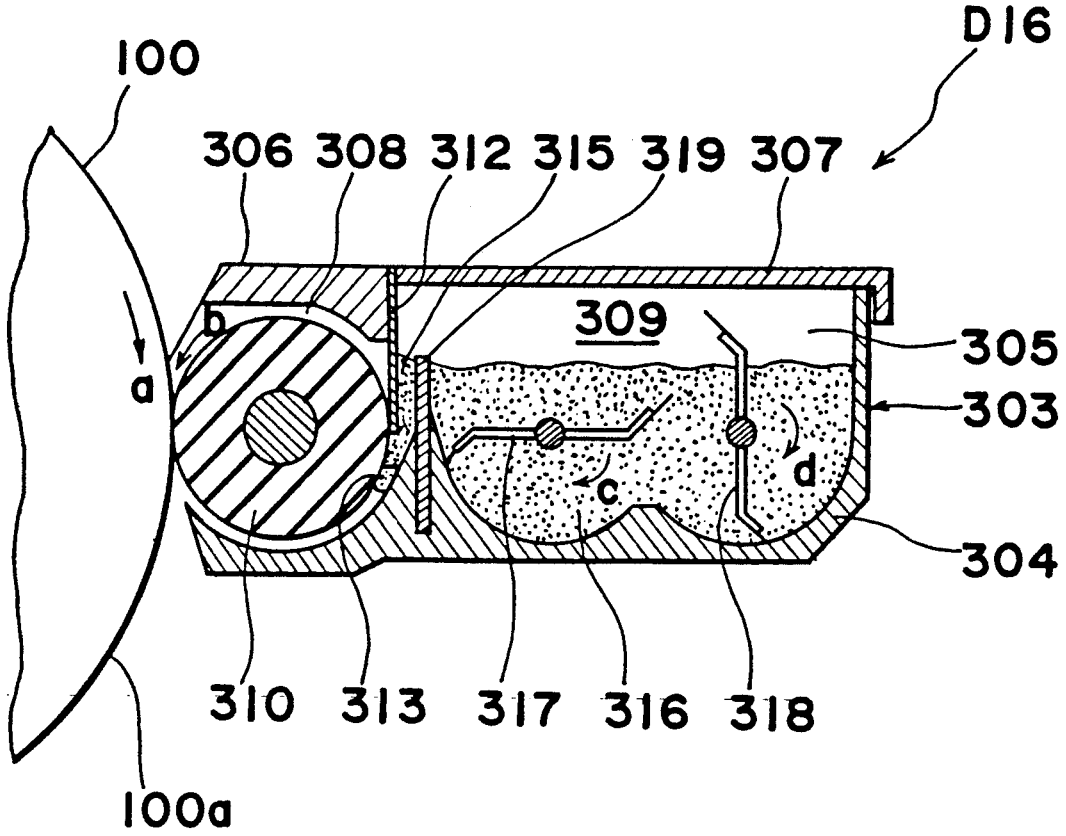
FIGS. 40 and 41 are schematic side sectional views of a developing apparatus according to a sixteenth embodiment of the present invention.
Figure 41:
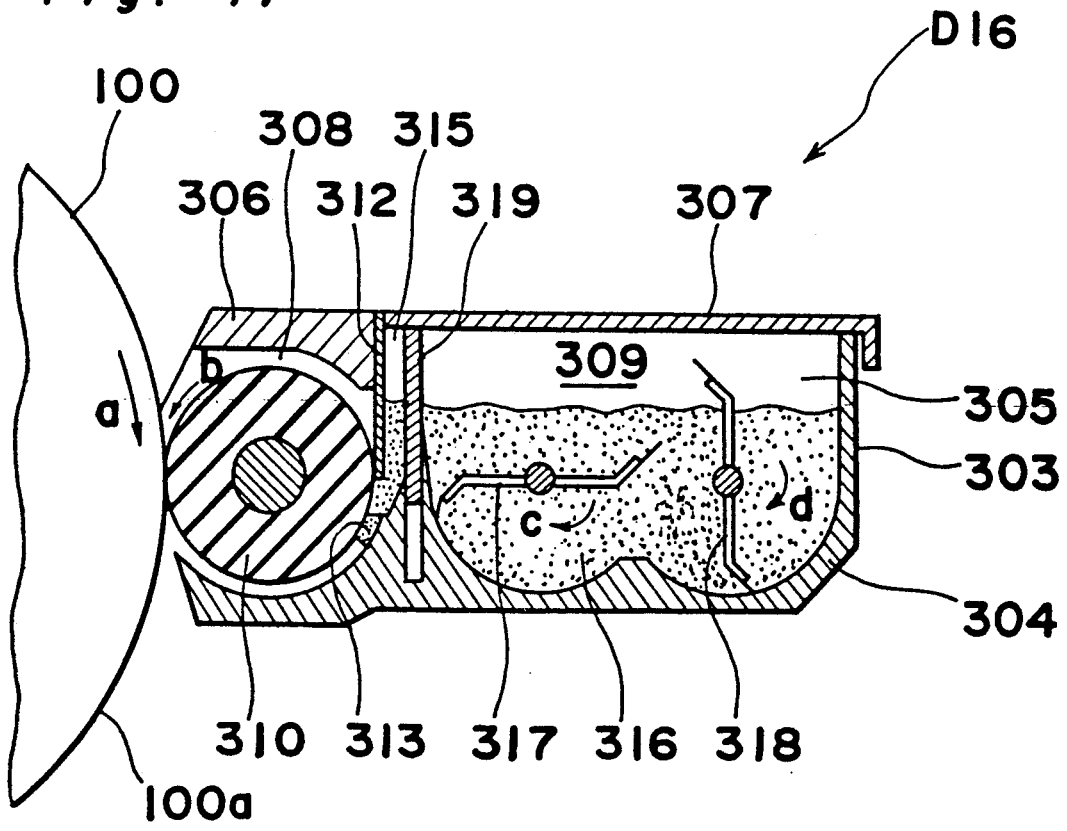

By the above construction, in the developing apparatus D16, when the photographic mode is selected, the partition wall 319 located at the lowered position as in FIG. 40 is elevated up to the raised position as shown in FIG. 41, and thus, the toner in the supply section 315 is consumed in state where the toner replenishment from the replenishing section 316 is cut off.

Accordingly, it is not necessary to set the stirring blades 317 and 318 to be in the non-operative state during collection of the toner in the supply section 315 as stated with reference to the developing apparatus D16 in FIG. 33.

Figure 42:
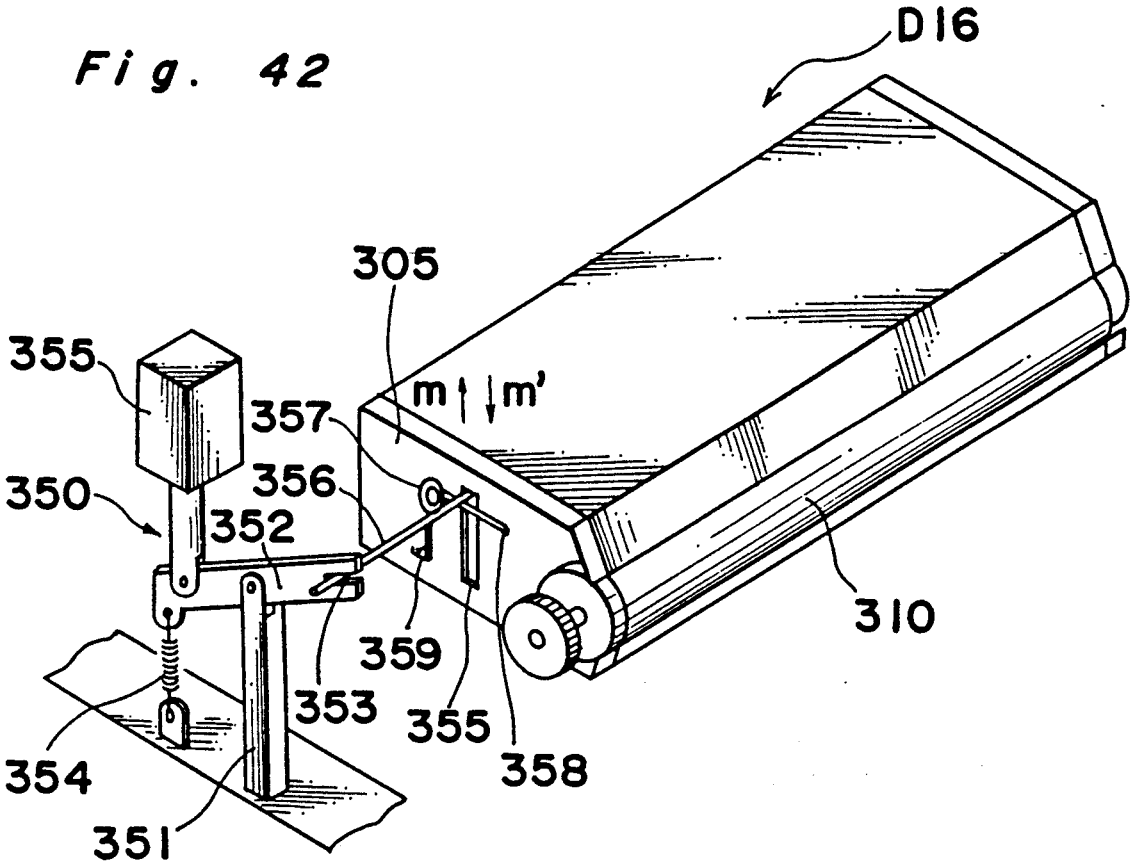
FIG. 42 is a perspective view of an open/close mechanism of a partition wall employed in the apparatus of the sixteenth embodiment.

The partition wall 319 referred to above is opened or closed, i.e. raised or lowered by an open/close device 350 as shown in FIG. 42, in which a lever 352 is pivotally supported, generally at its central portion, by a column 351 provided on the image forming apparatus main body. At one end of the lever 352, an engaging portion 353 is formed, while, at the other end of said lever 352, corresponding one end of a spring 354 connected at its other end to the image forming apparatus main body is engaged so that said the other end of the lever 352 may be urged downwardly thereby, while at the upper portion of the other end of the lever 352, a plunger of a solenoid 355 is pivotally connected. On the other hand, in the side casing 305 of the developing apparatus D16, a vertical slit 355 is formed, through which, an operating portion 356 provided on the partition wall 319 extends outwardly in a direction of an arrow m. This operating portion 356 is normally urged upwardly by one end of a coil spring 358 pivotally supported by a fixed portion 357 on the side casing 305, and engaged with an engaging portion 359 also provided on the side casing 305.

Thus, in the state where the developing apparatus D16 has been removed from the image forming apparatus, the partition wall 319 is urged upwardly by the spring 358 so as to cut off the communication between the supply section 315 and the replenishing section 316. Meanwhile, when the developing apparatus D16 is mounted on the image forming apparatus, the operating portion 356 is engaged with the engaging portion 353 of the lever 352. Thus, for example, the solenoid 355 is actuated for the pull function by the on-signal of the start key 341 to rotate the lever 358 so as to lower the operating portion 320 and the partition wall 319 in the state as shown in FIG. 40.

XIV. 17th embodiment

Figure 43:
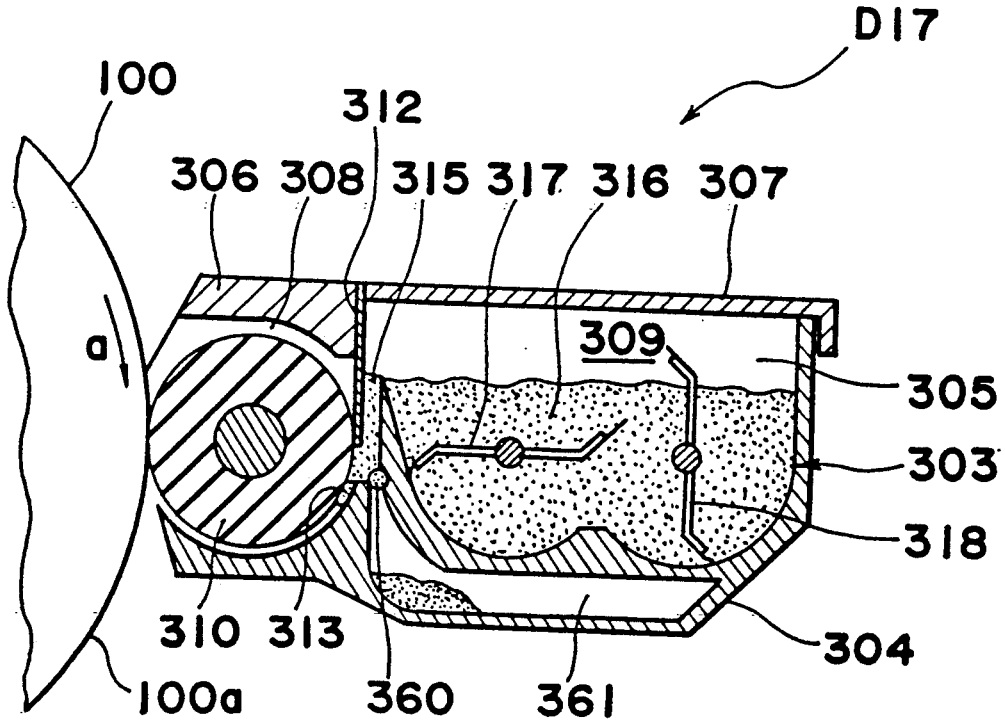
FIG. 43 is a schematic side sectional view of a developing apparatus according a seventeenth embodiment of the present invention.

In FIG. 43, there is shown another modified developing apparatus D17 of the developing apparatus D15 in FIG. 33, with like parts being designated by like reference numerals.

In the developing apparatus D17 in FIG. 43, a collecting section 361 is formed within the bottom casing 304 in a position below the toner hopper 309, with said collecting section 361 being communicated with the supply section 315, while a collecting roller 360 is rotatably provided at the communicating portion thereof, whereby the toner of the supply section 315 is adapted to be collected into the collecting section 361 through rotation of the collecting roller 360.

It should be noted here that, in the above embodiments, although the collecting section 361 is described as integrally formed within the casing 304, such collecting section may be modified to be separately constructed and detachably mounted to the housing 303.

It should also be noted that in the above embodiments, although the present invention is explained as it is applied to the image forming apparatus employing the developing apparatus which uses the mono-component developing material, the concept of the present invention is into limited in its application to the above type of the image forming apparatus alone, but may be applied to an image forming apparatus employing a developing apparatus which uses the two-component developing material disclosed, for, example, in Japanese Patent Application Tokugansho No. 62-292464 assigned to the same assignee as the present invention.

As is clear from the foregoing description, in the conventional image forming apparatuses, although the soft image quality is obtained by reducing the number of toner particles distributed in unit area, the present invention is arranged to achieve the soft image by supplying toner with small average particle diameter instead of adjusting the number of distributed toner particles.

Accordingly, in the image forming apparatus according to the present invention, the problem related to the sparse adhesion of toner particles, with consequent coarse grains of the image, is solved, and thus, an image of high quality with a good gradation may be obtained particularly for sharp reproduction of narrow lines and contour portions, etc.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing apparatus for forming a toner image onto an image carrier comprising:

a toner hopper in which toner is accommodated, a toner supply member adapted to contact the toner accommodated in said toner hopper for supplying the toner to the image carrier, a toner thickness restricting member held in contact with said toner supply member so as to form a thin layer of toner by passing toner through a portion between said restricting member and the toner supply member, a supply section provided in the toner supply and located at the side of the toner supply member for supplying toner to the toner supply member, said supply section accommodating first toner, and a replenish section provided in the toner hopper and communicated with the supply section for replenishing toner to the supply section, said replenish section accommodating second toner having particle diameters smaller than those of the first toner.

2. A developing apparatus as claimed in claim 1 wherein a developing sleeve is further provided to confront said toner supply member with the image carrier being disposed to face said developing sleeve.

3. A developing apparatus as claimed in claim 2 wherein said toner supply member and said developing sleeve are respectively impressed with a collecting bias voltage and a developing bias voltage.

4. A developing apparatus for forming a toner image onto an image carrier comprising:

a toner hopper in which toner is accommodated, a toner supply member adapted to contact the toner accommodated in said toner hopper for supplying the toner to image carrier, a toner thickness restricting member held in contact with said toner supply member so as to form a thin layer of toner by passing toner through a portion between said restricting member and the toner supply member, a supply section provided in the toner hopper and located at the side of the toner supply member for supplying toner to the toner supply member, said supply section accommodating first toner, a replenish section provided in the toner hopper and communicated with the supply section for replenishing toner to the supply section, said replenish section accommodating second toner having particle diameters smaller than those of the first toner, collecting means for collecting the first toner from the supply section in accordance with the toner image forming on the image carrier, and a collect section accommodating the collected toner by the collecting means.

5. A developing apparatus as claimed in claim 4 wherein said toner supply member is formed to be a rotatable roller and said collecting means is driven at a predetermined timing corresponding to rotations of said rotatable roller.

6. A developing apparatus as claimed in claim 4 wherein a developing sleeve is further provided to confront said toner supply member with the image carrier being disposed to face said developing sleeve.

7. A developing apparatus as claimed in claim 6 wherein said toner supply member and said developing sleeve are respectively impressed with a collecting bias voltage and a developing bias voltage.

8. A developing apparatus for use in an image forming apparatus employing an electrophotographic copying process, which comprises a toner hopper in which toner is accommodated, a toner supply member adapted to contact the toner accommodated in said toner hopper, and a toner layer thickness restricting member held in contact with said toner supply member so as to form a thin layer of toner by restricting the toner to be supported on the surface of the toner supply member based on displacement of said toner supply member, said toner hopper being divided into a supply section located at the side of the toner supply member and a replenishing section communicated with said supply section through an opening therebetween, said developing apparatus further including toner detecting means provided in the vicinity of said supply section and at said replenishing section respectively.

9. A developing apparatus as claimed in claim 8, wherein said toner detecting means includes an electrostatic capacity detecting type detector having a set of electrodes and provided in the vicinity of an opening for said supply section, and a pressure sensor provided at said replenishing section.

10. A developing apparatus as claimed in claim 8 wherein a developing sleeve is further provided to confront said toner supply member with the image carrier being disposed to face said developing sleeve.

11. A developing apparatus as claimed in claim 10 wherein said toner supply member and said developing sleeve are respectively impressed with a collecting bias voltage and a developing bias voltage.

12. An image forming apparatus for forming a toner image comprising:

forming means for forming first and second toner images on an image carrier, a toner supply member for supplying toner to the forming means, a toner restricting member held in contact with said toner supply member so as to form a thin layer of toner on a surface of the toner supply member by passing toner through a portion between said restrict member and the toner supply member, a toner supply section confronting the toner supply member for supplying toner to the toner supply member, said toner supply section accommodating first toner, a toner replenish section communicated with the toner supply section for replenishing toner to the supply section, said toner replenish section accommodating second toner having particle diameters smaller than those of the first toner, replenishing means for replenishing toner from the replenish section to the supply section, and controlling means for controlling the operation of the image forming apparatus, so that the replenishing means is inhibited from replenishing toner to the supply section with the forming means in operation so as to consume the toner accommodated in the supply section by forming the first toner image onto the image carrier in a first mode whereas the replenishing means is driven so as to replenish toner to the supply section with the forming means in operation so as to form the second toner image corresponding to an original document in a second mode.

13. An image forming apparatus as claimed in claim 12 further comprising cleaning means for cleaning the first toner image from the surface of the image carrier during the first mode so as to prepare for the second mode, and to form the second toner image on the image carrier in the second mode.

14. An image forming apparatus for forming a toner image comprising:

forming means for forming first and second toner images on an image carrier, a toner supply member for supplying toner to the forming means, a toner restricting member held in contact with said toner supply m ember so as to form a thin toner layer on the surface of the toner supply member by passing toner through a portion between said restricting member and the toner supply member, a toner supply section confronting the toner supply member for supplying toner to the toner supply member, said toner supply section accommodating first toner, a toner replenish section communicating with the toner supply section by an opening for replenishing toner to the supply section, said toner replenish section accommodating second toner having particle diameters smaller than those of the first toner, replenishing means for replenishing toner from the replenish section to the supply section, shutter means for shuttering the opening so as to prevent toner from being replenished by the replenishing means, and controlling means for controlling the operation of the image forming apparatus, so that the shutter means is driven to prevent toner from being replenished from the replenish section the supply section so as to consume the toner accommodated in the supply section by forming the first toner image on the image carrier by the forming means in a first mode, whereas the shutter means is inhibited from being driven and the second toner image corresponding to an original document is formed on the image carrier by the forming means in a second mode.

15. An image forming apparatus as claimed in claim 14 further comprising cleaning means for cleaning the first toner image from the surface of the image carrier during the first mode so as to prepare for the second mode, and to form the second toner image on the image carrier in the second mode.

* * * * *